US011872441B2

(12) United States Patent
Lagree et al.

(10) Patent No.: US 11,872,441 B2
(45) Date of Patent: Jan. 16, 2024

(54) EXERCISE MACHINE RAIL SYSTEM

(71) Applicant: Lagree Technologies, Inc., Chatsworth, CA (US)

(72) Inventors: Sebastien Anthony Louis Lagree, Chatsworth, CA (US); Max Wunderlich, Los Angeles, CA (US)

(73) Assignee: Lagree Technologies, Inc., Chatsworth (CA)

( * ) Notice: Subject to any disclaimer, the term of this patent is extended or adjusted under 35 U.S.C. 154(b) by 30 days.

(21) Appl. No.: 17/348,416

(22) Filed: Jun. 15, 2021

(65) Prior Publication Data

US 2022/0395718 A1 Dec. 15, 2022

(51) Int. Cl.

| | |
|---|---|
| ***A63B 21/00*** | (2006.01) |
| ***A63B 21/04*** | (2006.01) |
| ***A63B 22/00*** | (2006.01) |

(52) U.S. Cl.

CPC ..... *A63B 21/4045* (2015.10); *A63B 21/0428* (2013.01); *A63B 21/154* (2013.01); *A63B 22/0087* (2013.01)

(58) Field of Classification Search

CPC ..... A63B 21/0428; A63B 21/0628; A63B 21/154; A63B 21/4035; A63B 21/4039; A63B 21/4045; A63B 22/0076; A63B 22/0087; A63B 22/0089; A63B 22/14; A63B 22/20; A63B 22/201; A63B 22/203

See application file for complete search history.

(56) References Cited

U.S. PATENT DOCUMENTS

| | | | | |
|---|---|---|---|---|
| 1,621,477 | A | 8/1925 | Pilates | |
| 3,770,267 | A | 11/1973 | McCarthy | |
| 4,759,540 | A | 7/1988 | Yu | |
| 4,798,378 | A | 1/1989 | Jones | |
| 5,066,005 | A | 11/1991 | Luecke | |
| 5,263,913 | A | 11/1993 | Boren | |
| 5,295,935 | A * | 3/1994 | Wang | A63B 21/4033 482/130 |
| D362,700 | S | 9/1995 | Breibart | |
| D382,319 | S | 8/1997 | Gerschefske | |

(Continued)

FOREIGN PATENT DOCUMENTS

WO 2004/096376 A1 11/2004

*Primary Examiner* — Loan B Jimenez
*Assistant Examiner* — Zachary T Moore
(74) *Attorney, Agent, or Firm* — Neustel Law Offices

(57) ABSTRACT

A rail system for an exercise machine which may be efficiently manufactured with different dimensions to suit different exercisers and exercise spaces. An exemplary embodiment includes a first rail, a second rail, a carriage movably connected to the first and second rails, at least one biasing member or elongated member adapted to be directly or indirectly connected to the carriage, and one or more spacers extending between the first and second rails. A lower member is connected between the rails beneath the spacers so as to enclose the space between the rails. The lower member includes a plurality of dividers defining channels in which elongated members or biasing members may extend. The spacers, rails, and lower member form a monorail configuration. The effective width of the monorail may be easily adjusted by simply using spacers having different widths, thus easing the manufacture of such exercise machines having different sizes.

22 Claims, 18 Drawing Sheets

(56) References Cited

U.S. PATENT DOCUMENTS

| | | | | |
|---|---|---|---|---|
| 5,681,249 | A | 10/1997 | Endelman | |
| 5,885,197 | A | 3/1999 | Barton | |
| 5,967,955 | A | 10/1999 | Westfall | |
| 6,179,753 | B1 | 1/2001 | Barker | |
| 7,163,500 | B2 | 1/2007 | Endelman | |
| 7,803,095 | B1 | 9/2010 | Lagree | |
| 7,931,570 | B2 | 4/2011 | Hoffman | |
| 8,249,714 | B1 | 8/2012 | Hartman | |
| 8,585,554 | B2 | 11/2013 | Shavit | |
| 9,555,282 | B1 * | 1/2017 | Lagree | A63B 21/0428 |
| 9,579,555 | B2 * | 2/2017 | Lagree | A63B 21/151 |
| 10,046,193 | B1 * | 8/2018 | Aronson | A63B 21/4034 |
| 2001/0056011 | A1 | 12/2001 | Endelman | |
| 2003/0119635 | A1 | 6/2003 | Arbuckle | |
| 2005/0130810 | A1 | 6/2005 | Sands | |
| 2005/0164856 | A1 | 7/2005 | Parmater | |
| 2006/0046914 | A1 | 3/2006 | Endelman | |
| 2006/0199712 | A1 | 9/2006 | Barnard | |
| 2008/0015095 | A1 * | 1/2008 | Savsek | A63B 21/151 482/121 |
| 2008/0070765 | A1 | 3/2008 | Brown | |
| 2008/0248935 | A1 | 10/2008 | Solow | |
| 2010/0227748 | A1 | 9/2010 | Campanaro | |
| 2011/0143898 | A1 | 6/2011 | Trees | |
| 2011/0166002 | A1 | 7/2011 | Savsek | |
| 2011/0172069 | A1 | 7/2011 | Gerschefske | |
| 2012/0295771 | A1 | 11/2012 | Lagree | |
| 2013/0196835 | A1 | 8/2013 | Solow | |
| 2014/0011645 | A1 | 1/2014 | Johnson | |
| 2014/0100089 | A1 | 4/2014 | Kermath | |
| 2014/0121076 | A1 | 5/2014 | Lagree | |
| 2014/0121078 | A1 | 5/2014 | Lagree | |
| 2014/0121079 | A1 | 5/2014 | Lagree | |
| 2014/0141948 | A1 | 5/2014 | Aronson | |
| 2015/0024914 | A1 | 1/2015 | Lagree | |
| 2015/0057127 | A1 | 2/2015 | Lagree | |
| 2015/0065318 | A1 | 3/2015 | Lagree | |
| 2015/0072841 | A1 | 3/2015 | Lagree | |
| 2015/0141204 | A1 | 5/2015 | Lagree | |
| 2015/0217164 | A1 | 8/2015 | Lagree | |
| 2015/0220523 | A1 | 8/2015 | Lagree | |
| 2015/0246263 | A1 | 9/2015 | Campanaro | |
| 2015/0297944 | A1 | 10/2015 | Lagree | |
| 2015/0343250 | A1 | 12/2015 | Lagree | |
| 2015/0360068 | A1 | 12/2015 | Lagree | |
| 2015/0360083 | A1 | 12/2015 | Lagree | |
| 2015/0360113 | A1 | 12/2015 | Lagree | |
| 2015/0364058 | A1 | 12/2015 | Lagree | |
| 2015/0367166 | A1 | 12/2015 | Lagree | |
| 2016/0008657 | A1 | 1/2016 | Lagree | |
| 2016/0059060 | A1 | 3/2016 | Lagree | |
| 2016/0059061 | A1 | 3/2016 | Lagree | |
| 2016/0096059 | A1 | 4/2016 | Lagree | |
| 2016/0166870 | A1 | 6/2016 | Lagree | |
| 2016/0193496 | A1 | 7/2016 | Lagree | |
| 2016/0256733 | A1 | 9/2016 | Lagree | |
| 2016/0271452 | A1 | 9/2016 | Lagree | |
| 2016/0317858 | A1 | 11/2016 | Lagree | |
| 2016/0346593 | A1 | 12/2016 | Lagree | |
| 2016/0361602 | A1 | 12/2016 | Lagree | |
| 2017/0014664 | A1 | 1/2017 | Lagree | |
| 2017/0014672 | A1 | 1/2017 | Lagree | |
| 2017/0036057 | A1 | 2/2017 | Lagree | |
| 2017/0036061 | A1 | 2/2017 | Lagree | |
| 2017/0065846 | A1 | 3/2017 | Lagree | |
| 2017/0072252 | A1 | 3/2017 | Lagree | |
| 2017/0087397 | A1 | 3/2017 | Lagree | |
| 2017/0100625 | A1 | 4/2017 | Lagree | |
| 2017/0100629 | A1 | 4/2017 | Lagree | |
| 2017/0106232 | A1 | 4/2017 | Lagree | |
| 2017/0113091 | A1 | 4/2017 | Lagree | |
| 2017/0120101 | A1 | 5/2017 | Lagree | |
| 2017/0144013 | A1 | 5/2017 | Lagree | |
| 2017/0157452 | A1 | 6/2017 | Lagree | |
| 2017/0157458 | A1 | 6/2017 | Lagree | |
| 2017/0165518 | A1 | 6/2017 | Lagree | |
| 2017/0165555 | A1 | 6/2017 | Lagree | |
| 2017/0189740 | A1 | 7/2017 | Lagree | |
| 2017/0189741 | A1 | 7/2017 | Lagree | |
| 2017/0209728 | A1 | 7/2017 | Lagree | |
| 2017/0239526 | A1 | 8/2017 | Lagree | |
| 2017/0246491 | A1 | 8/2017 | Lagree | |
| 2017/0246499 | A1 | 8/2017 | Lagree | |
| 2017/0296865 | A1 | 10/2017 | Lagree | |
| 2017/0304673 | A1 | 10/2017 | Lagree | |
| 2017/0326406 | A1 | 11/2017 | Lagree | |
| 2017/0340947 | A1 | 11/2017 | Lagree | |
| 2017/0354840 | A1 | 12/2017 | Lagree | |
| 2018/0015319 | A1 | 1/2018 | Lagree | |
| 2018/0021621 | A1 | 1/2018 | Lagree | |
| 2018/0021655 | A1 | 1/2018 | Lagree | |
| 2018/0036583 | A1 | 2/2018 | Lagree | |
| 2018/0056109 | A1 | 3/2018 | Lagree | |
| 2018/0056133 | A1 | 3/2018 | Lagree | |
| 2018/0111020 | A1 | 4/2018 | Lagree | |
| 2018/0111033 | A1 | 4/2018 | Lagree | |
| 2018/0117392 | A1 | 5/2018 | Lagree | |
| 2018/0133532 | A1 | 5/2018 | Lagree | |
| 2018/0133533 | A1 | 5/2018 | Lagree | |
| 2018/0133534 | A1 | 5/2018 | Lagree | |
| 2018/0133542 | A1 | 5/2018 | Lagree | |
| 2018/0178053 | A1 | 6/2018 | Lagree | |
| 2018/0193691 | A1 | 7/2018 | Lagree | |
| 2018/0250551 | A1 | 9/2018 | Lagree | |
| 2018/0250573 | A1 | 9/2018 | Lagree | |
| 2018/0272179 | A1 | 9/2018 | Lagree | |
| 2018/0280782 | A1 | 10/2018 | Lagree | |
| 2018/0318627 | A1 | 11/2018 | Lagree | |
| 2018/0318646 | A1 | 11/2018 | Lagree | |
| 2018/0326252 | A1 | 11/2018 | Lagree | |
| 2018/0353803 | A1 | 12/2018 | Lagree | |
| 2018/0361190 | A1 | 12/2018 | Lagree | |
| 2018/0361197 | A1 | 12/2018 | Lagree | |
| 2019/0083842 | A1 | 3/2019 | Lagree | |
| 2019/0160320 | A1 | 5/2019 | Lagree | |
| 2019/0160329 | A1 | 5/2019 | Lagree | |
| 2019/0232105 | A1 | 8/2019 | Lagree | |
| 2019/0240530 | A1 | 8/2019 | Lagree | |
| 2019/0247694 | A1 | 8/2019 | Lagree | |
| 2019/0247705 | A1 | 8/2019 | Lagree | |
| 2019/0247707 | A1 | 8/2019 | Lagree | |
| 2019/0255375 | A1 | 8/2019 | Lagree | |
| 2019/0269961 | A1 | 9/2019 | Lagree | |
| 2019/0314672 | A1 | 10/2019 | Lagree | |
| 2019/0358484 | A1 | 11/2019 | Lagree | |
| 2020/0030657 | A1 | 1/2020 | Lagree | |
| 2020/0047051 | A1 * | 2/2020 | Lagree | A63B 22/0023 |
| 2020/0054913 | A1 | 2/2020 | Lagree | |
| 2020/0078630 | A1 | 3/2020 | Lagree | |
| 2020/0078634 | A1 | 3/2020 | Lagree | |
| 2020/0171337 | A1 | 6/2020 | Lagree | |
| 2020/0353306 | A1 | 11/2020 | Lagree | |
| 2020/0376326 | A1 | 12/2020 | Lagree | |
| 2020/0376359 | A1 | 12/2020 | Lagree | |
| 2021/0069542 | A1 | 3/2021 | Lagree | |
| 2021/0069572 | A1 | 3/2021 | Lagree | |
| 2021/0086023 | A1 | 3/2021 | Lagree | |
| 2021/0101048 | A1 | 4/2021 | Lagree | |
| 2021/0121734 | A1 | 4/2021 | Lagree | |
| 2021/0154555 | A1 | 5/2021 | Lagree | |

* cited by examiner

EXERCISE MACHINE RAIL SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

The described example embodiments in general relate to rails for an exercise machine which may be efficiently manufactured with different dimensions to suit different exercisers and exercise spaces.

Many modern exercise machines utilize tracks on which a movable structure, such as a carriage, platform, handle, or the like, may be movably connected. Such tracks will generally include one or more rails on which such a movable structure may be moved, such by reciprocation, by an exerciser.

Exercisers come in all shapes and sizes. While a specific type of track may be desirable for a first type of exerciser, that same type of track may not be desirable for a second type of exerciser. As a non-limiting example, a shorter exerciser may benefit from a shorter, narrower track. Conversely, a taller exerciser may benefit from a longer, wider track.

Additionally, space considerations dictate the type of track used with various exercise machines. An exercise machine with a longer, wider track may be ideal for a large space such as an exercise studio, but would take up valuable space in a corner of a garage in one's home. Thus, it may be preferable to offer exercise machines having larger tracks for exercise spaces with more square footage available and exercise machines having smaller tracks for exercise spaces with less square footage available.

When designing and manufacturing such exercise machines, the dimensions of such a track may present design constraints. It would thus be beneficial for an exercise machine design to be easily configurable between smaller (e.g., shorter and/or narrower) and larger (e.g., longer and/or wider) tracks so that multiple exercise machines having different track sizes may be efficiently manufactured using similar designs without affecting the design of the overall machine.

SUMMARY

Some of the various embodiments of the present disclosure relate to an exercise machine that can be efficiently manufactured with different rail dimensions to suit different exercisers and exercise spaces. Some of the various embodiments of the present disclosure include a first rail, a second rail, a carriage movably connected to the first and second rails, at least one biasing member adapted to be connected to the carriage, and one or more spacers extending between the first and second rails. In some example embodiments, a single spacer may be utilized which includes an upper opening and extends along the entire length of the first and second rails. In some other example embodiments, a pair of spacers may be utilized, with the first spacer extending at least half of the length of the first and second rails, the second spacer extending less than half of the length of the first and second rails, and the upper opening being defined between the pair of spacers.

There has thus been outlined, rather broadly, some of the embodiments of the present disclosure in order that the detailed description thereof may be better understood, and in order that the present contribution to the art may be better appreciated. There are additional embodiments of that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

Figure 1A:
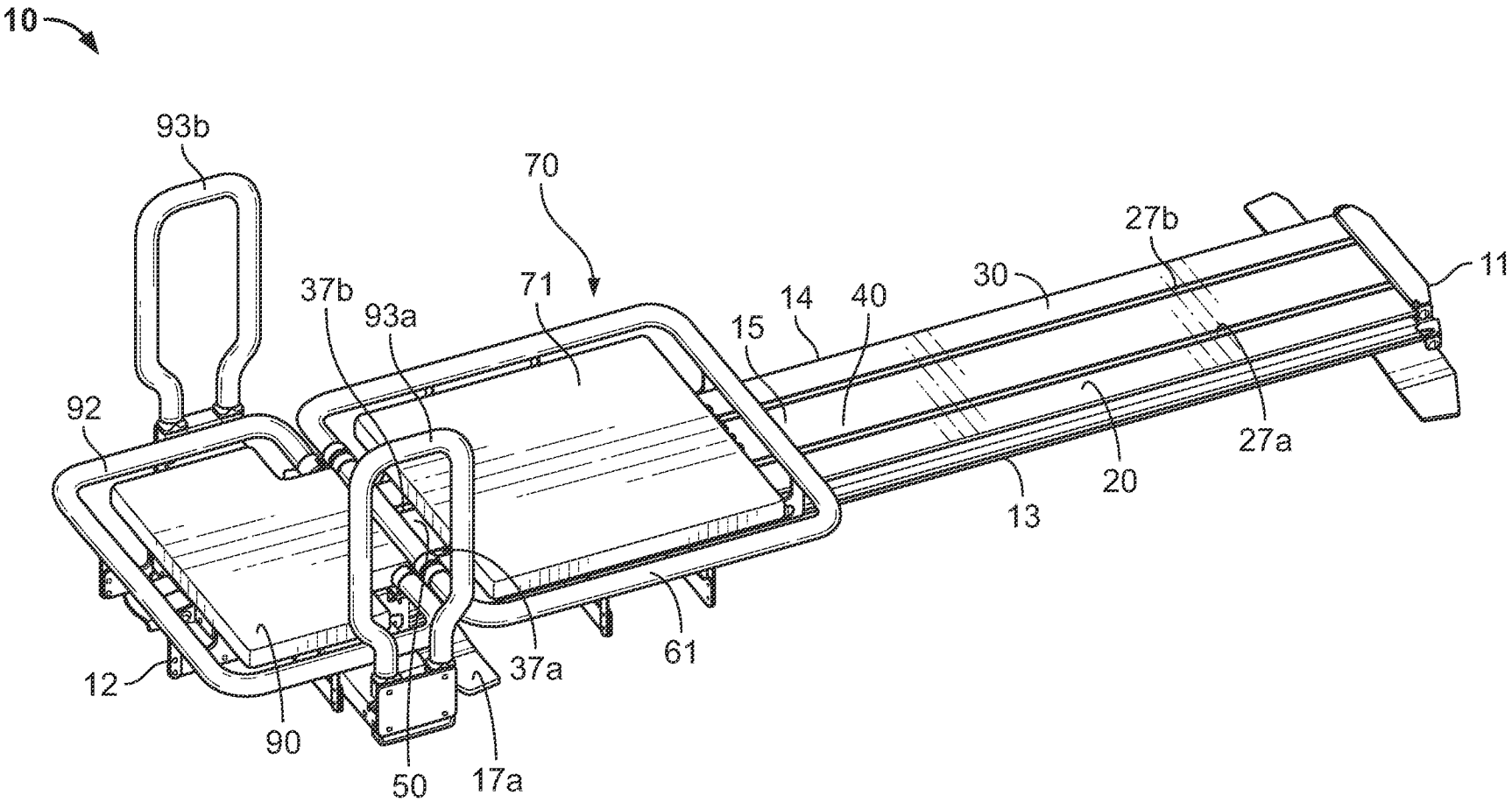
FIG. 1A is a perspective view of an exercise machine rail system in accordance with an example embodiment.

A. Overview.

Some of the various embodiments of the present disclosure relate to an exercise machine that can be efficiently manufactured with different rail dimensions to suit different exercisers and exercise spaces. Some of the various embodiments of the present disclosure include a first rail 20, a second rail 30, a carriage 70 movably connected to the first and second rails 20, 30, at least one biasing member 80 adapted to be connected to the carriage 70, and one or more spacers 40, 50 extending between the first and second rails 20, 30. In some example embodiments, a single spacer 40 may be utilized which includes an upper opening 58 and extends along the entire length of the first and second rails 20, 30. In some other example embodiments, a pair of spacers 40, 50 may be utilized, with the first spacer 40 extending at least half of the length of the first and second rails 20, 30, the second spacer 50 extending less than half of the length of the first and second rails 20, 30, and the upper opening 58 being defined between the pair of spacers 40, 50.

The figures illustrate an exemplary exercise machine 10 which may be utilized in connection with the exercise machine rail system. The exercise machine 10 may be comprised of various types of exercise machines such as but not limited to a reformer exercise machine, exercise bicycle, rowing machine, elliptical trainer, treadmill, and the like. It should be appreciated that the exemplary embodiments shown in the figures are merely for illustrative purposes, and thus the scope should not be construed as limited to any particular exercise machine configuration shown in the figures.

As best shown in FIG. 1, the exercise machine 10 will generally include a first end 11, a second end 12, a first side 13, a second side 14, an upper end 15, and a lower end 16. The exercise machine 10 may comprise various shapes, sizes, and configurations. Thus, the shape, size, and configuration of the exercise machine 10 should not be construed as limited by the exemplary figures. The exercise machine 10 may comprise various structural elements forming a frame. Generally, the exercise machine 10 will be comprised of both fixed elements (e.g., legs 17*a*, 17*b*, rails 20, 30, and spacers 40, 50) and movable elements (e.g., carriage 70).

An exemplary embodiment of an exercise machine 10 may include a first rail 20, a second rail 30, and a carriage 70 movably connected to the first rail 20 and the second rail 30. The carriage 70 may be adapted to be movable along a portion of the first rail 20 and the second rail 30. At least one elongated member 81 may be adapted to be connected to the carriage 70. A first spacer 40 may extend between the first rail 20 and the second rail 30, with the first spacer 40 extending along at least half of a length of the first rail 20 and at least half of a length of the second rail 30.

The first spacer 40 may extend along at least 65% of the length of the first rail 20 and at least 65% of the length of the second rail 30. In another embodiment, the first spacer 40 may extend along approximately 70% of the length of the first rail 20 and approximately 70% of the length of the second rail 30. In yet another embodiment, the first spacer 40 may extend along at least 95% of the length of the first rail 20 and at least 95% of the length of the second rail 30.

At least one pulley 84 may be positioned between the first rail 20 and the second rail 30, with the at least one elongated member 81 being connected to the at least one pulley 84. The first spacer 40 may include an upper opening 58, with the at least one pulley 84 extending partially out of the upper opening 58. The first spacer 40 may be slidably connected to the first rail 20 and the second rail 30. A first side portion 42 of the first spacer 40 may be connected to a first inner edge 21 of the first rail 20 and a second side portion 43 of the first spacer 40 may be connected to a second inner edge 31 of the second rail 30. The first side portion 42 of the first spacer 40 may include a first connector 44 and the second side portion 43 of the first spacer 40 may include a second connector 46. The first connector 44 may be connected to the first rail 20 and the second connector 46 may be connected to the second rail 30.

The first connector 44 may comprise a first flange 45 and the second connector 46 may comprise a second flange 47. The first rail 20 may include a first inner connector 23 such as a first receiver slot and the second rail 30 may include a second inner connector 33 such as a second receiver slot. The first flange 45 may be adapted to engage within the first inner connector 23 and the second flange 47 may be adapted to engage within the second inner connector 33. The first flange 45 and the second flange 47 may each extend along an entire length of the first spacer 40.

The first spacer 40 may be comprised of an inverted U-shape including a central portion 41, a first side portion 42 extending downwardly at an angle from a first side of the central portion 41, and a second side portion 43 extending downwardly at an angle from a second side of the central portion 41. The first spacer 40 may be comprised of a sheet of material and may enclose a gap between the first and second rails 20, 30.

A first side insert 27*a* may be positioned between a first side of the first spacer 40 and the first rail 20 and a second side insert 27*b* may be positioned between a second side of the first spacer 40 and the second rail 30. A lower member 60 may extend between the first rail 20 and the second rail 30 below the first spacer 40. The lower member 60 may include a plurality of dividers 62 such as a plurality or ribs defining a plurality of channels 63, with the at least one elongated member 81 being positioned within at least one of the plurality of channels 63.

A second spacer 50 may extend between the first rail 20 and the second rail 30, with an upper opening 58 being positioned and defined between the first spacer 40 and the second spacer 50. The second spacer 50 may extend along less than half of the length of the first rail 20 and less than half of the length of the second rail 30.

In another exemplary embodiment, an exercise machine 10 may comprise a first rail 20 including a first inner edge 21 and a first outer edge 22 and a second rail 30 including a second inner edge 31 and a second outer edge 32. The first rail 20 may include a first outer channel 24 along the first outer edge 22 and the second rail 30 may include a second outer channel 34 along the second outer edge 32. The first rail 20 may be parallel to the second rail 30.

A carriage 70 may be movably connected to the first rail 20 and the second rail 30, with the carriage 70 being adapted to be movable along a portion of the first rail 20 and the second rail 30. The carriage 70 may include first wheels 73, 74 and second wheels 75, 76, with the first wheels 73, 74 being adapted to move within the first outer channel 24 and the second wheels 75, 76 being adapted to move within the second outer channel 34. At least one elongated member 81 may be adapted to be connected to the carriage 70.

A first spacer 40 may extend between the first and second rails 20, 30, with the first spacer 40 extending along at least half of a length of the first rail 20 and at least half of a length of the second rail 30. A first side of the first spacer 40 may be connected to the first inner edge 21 of the first rail 20 and a second side of the first spacer 40 may be connected to the second inner edge 31 of the second rail 30. A second spacer 50 may extend between the first and second rails 20, 30, with the second spacer 50 extending along less than half of the length of the first rail 20 and less than half of the length of the second rail 30. An upper opening 58 may be positioned between the first spacer 40 and the second spacer 50. A pulley 84 may be positioned between the first and second rails 20, 30, with the pulley 84 extending partially out of the upper opening 58. The at least one elongated member 81 may be connected to the pulley 84.

B. Rails.

Figure 1B:
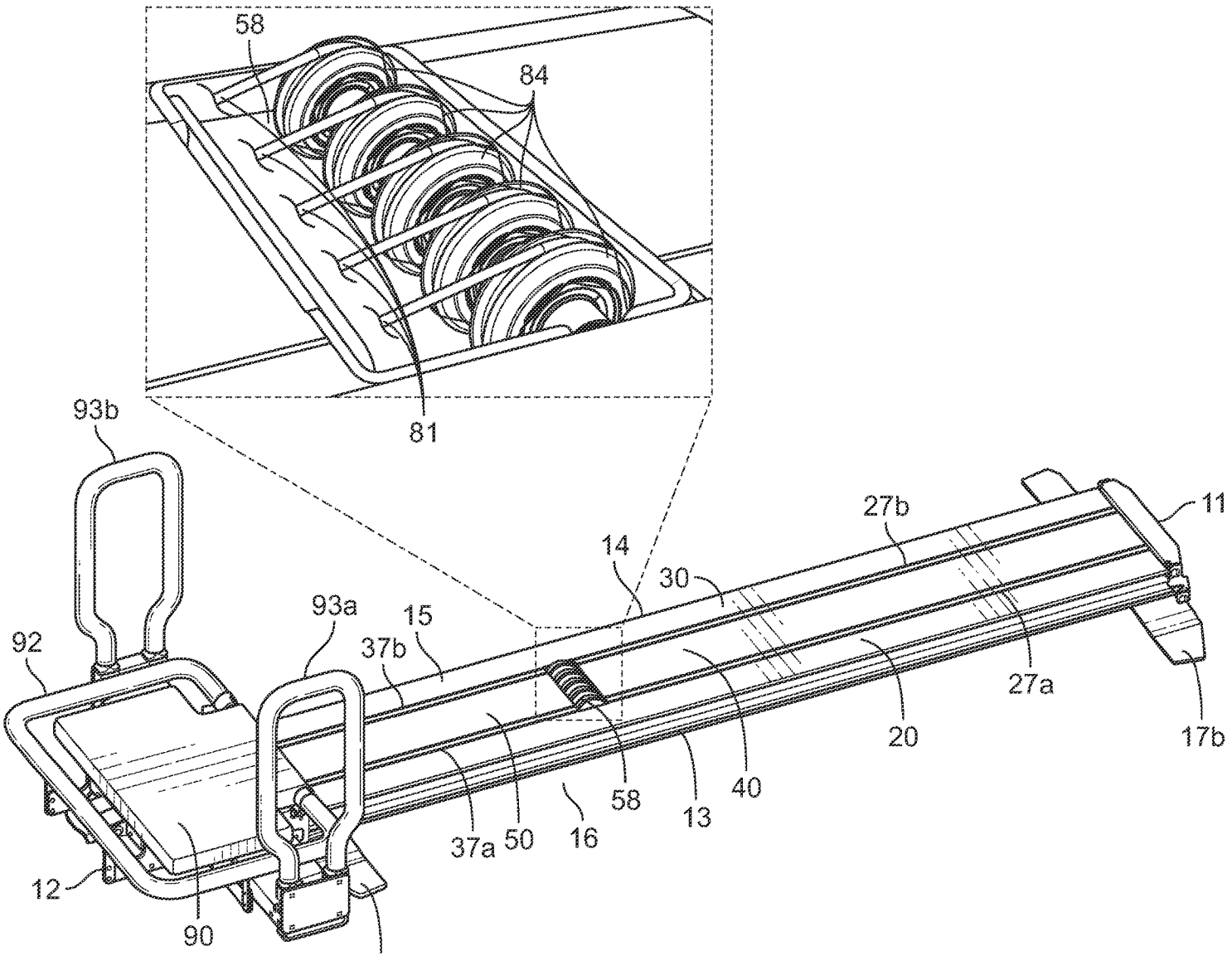
FIG. 1B is a perspective view of an exercise machine rail system with the carriage removed in accordance with an example embodiment.
Figure 1C:
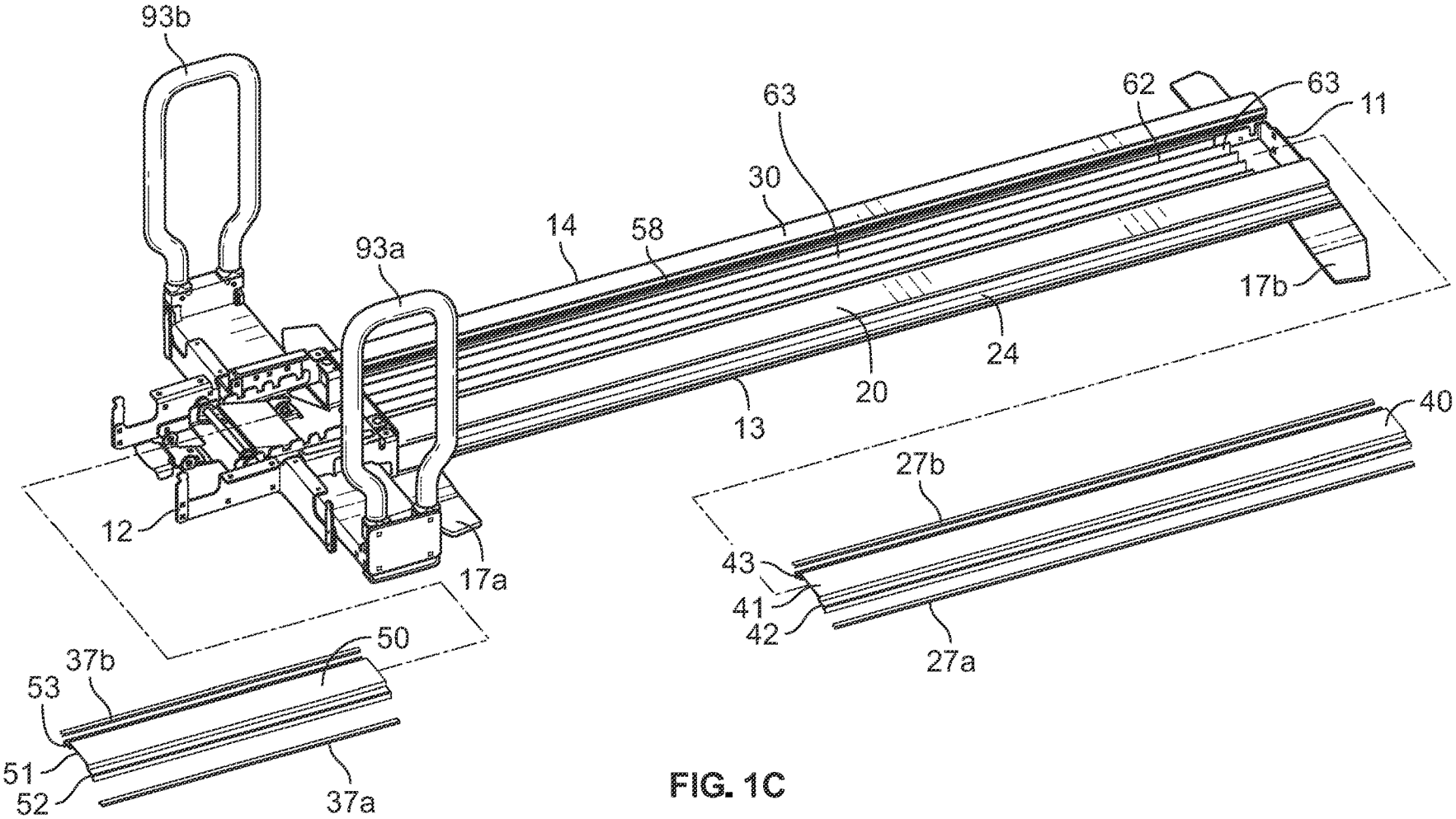
FIG. 1C is an exploded perspective view of an exercise machine rail system with the carriage and end platform removed in accordance with an example embodiment.
Figure 3:
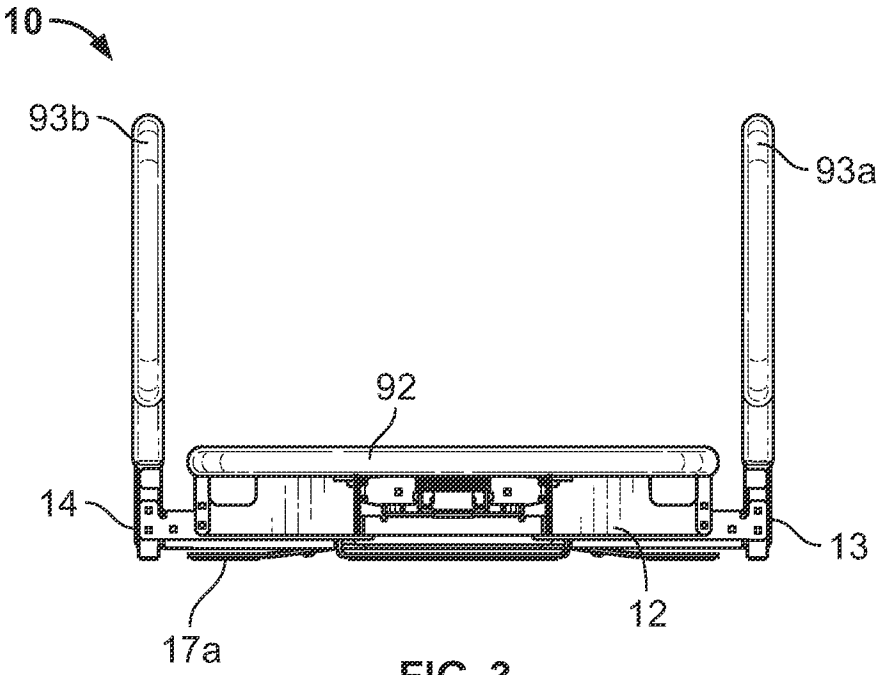
FIG. 3 is a second end view of an exercise machine rail system in accordance with an example embodiment.

As best shown in FIGS. 1A, 1B, and 1C, the exercise machine 10 will generally include a pair of rails 20, 30 on which a carriage 70 may be movably connected. The shape, size (e.g., length and width), positioning, and orientation of the rails 20, 30 may vary in different embodiments, and thus should not be construed as limited by the exemplary embodiments shown in the figures. Through the use of spacers 40, 50 and side inserts 27, 37, the pair of rails 20, 30 may have the appearance of a single monorail such as shown in the figures.

Each of the rails 20, 30 generally comprise an elongated member. The material utilized for the rails 20, 30 may vary in different embodiments. The rails 20, 30 may be comprised of various metals, metal alloys, plastics, woods, and/or composite materials in different embodiments. The rails 20, 30 may be substantially tubular, with a hollow interior such as shown in FIGS. 8-14.

Figure 15A:
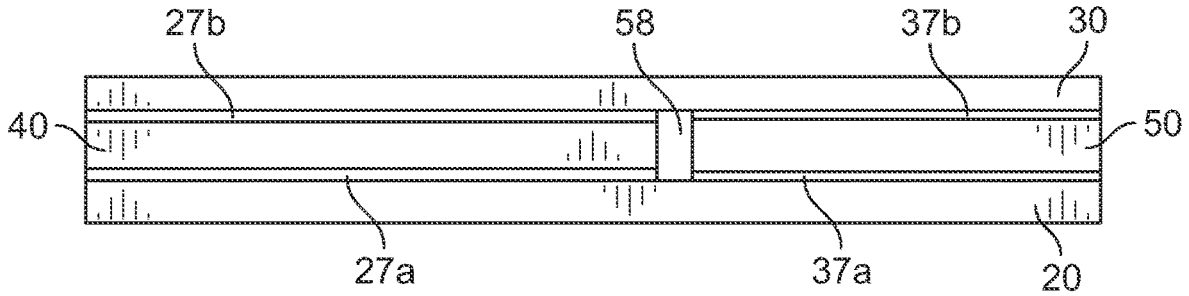
FIG. 15A is a top view of a rails and a pair of spacers of an exercise machine rail system in accordance with an example embodiment.
Figure 15B:
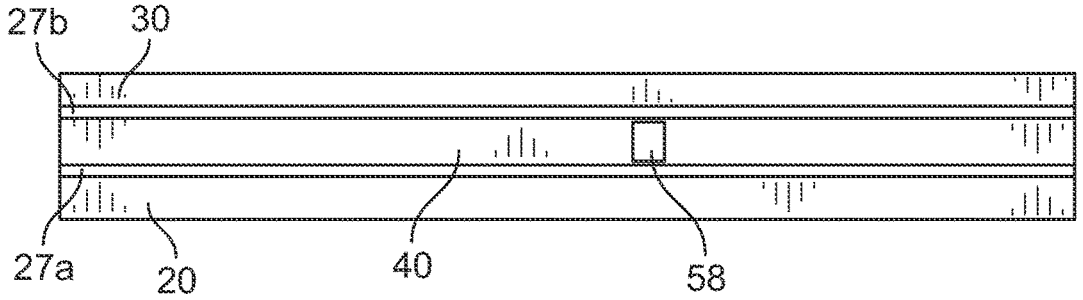
FIG. 15B is a top view of rails and single spacer with an opening of an exercise machine rail system in accordance with an example embodiment.
Figure 15C:
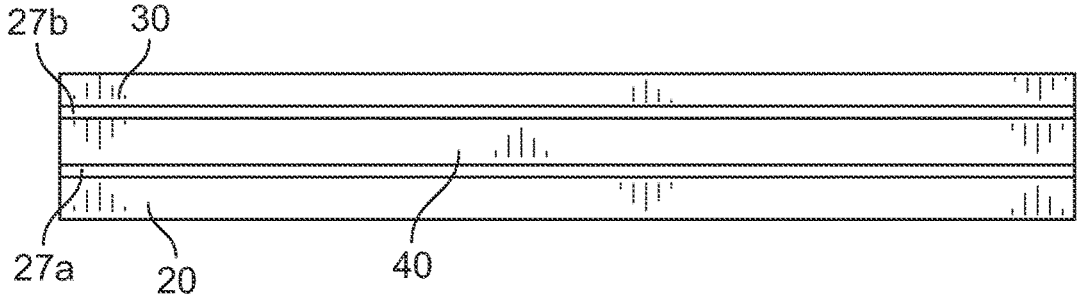
FIG. 15C is a top view of rails and a single spacer without an opening of an exercise machine rail system in accordance with an example embodiment.
Figure 16:
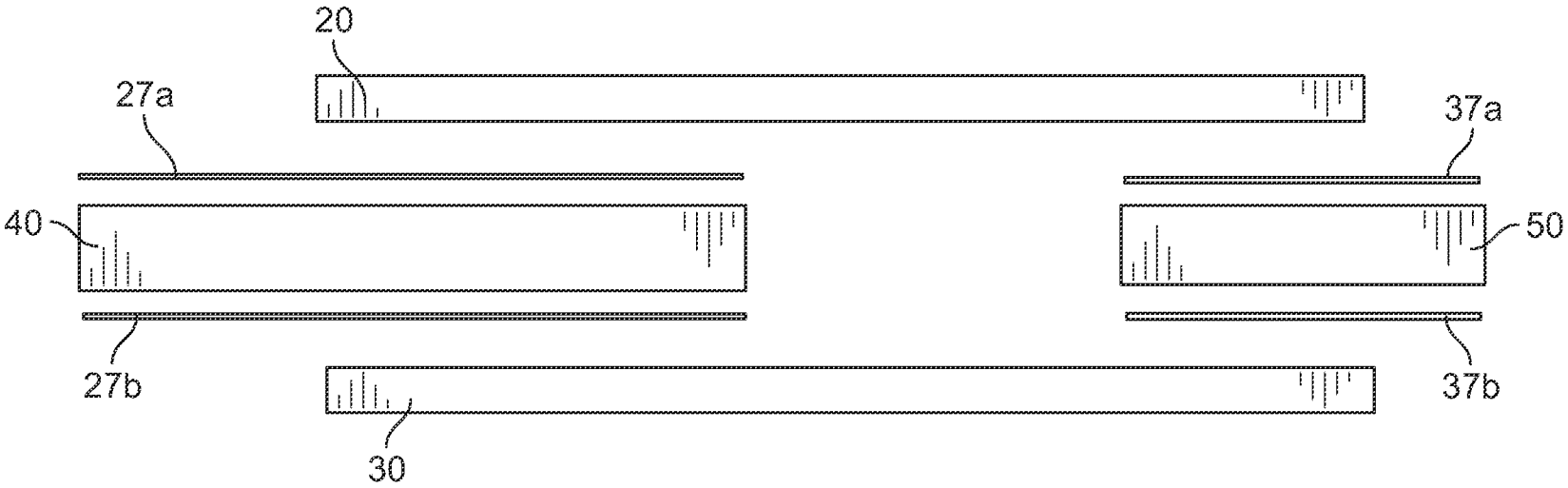
FIG. 16 is a top exploded view of rails and a pair of spacers of an exercise machine rail system in accordance with an example embodiment.
Figure 17:
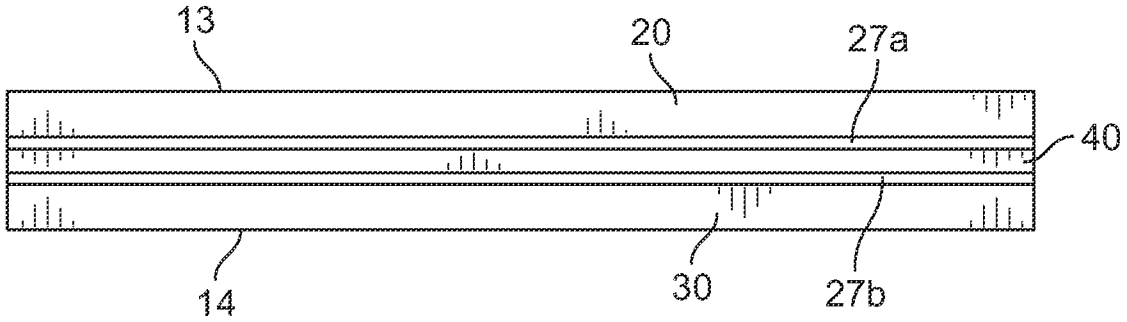
FIG. 17 is a top view of rails and a single spacer of an exercise machine rail system in accordance with an example embodiment.

The rails 20, 30 may be parallel to each other, or may be slightly angled away from or towards each other. The spacing between the rails 20, 30 will vary in different embodiments. As an example, it can be seen that FIGS. 15A, 15B, and 15C illustrate an embodiment in which the rails 20, 30 are further apart, and FIG. 17 illustrates an embodiment in which the rails 20, 30 are closer together. By using spacers 40, 50 as discussed herein, the exercise machine 10 may be efficiently manufactured with different distances between the respective rails 20, 30 to accommodate different types of exerciser and exercise spaces.

Figure 6:
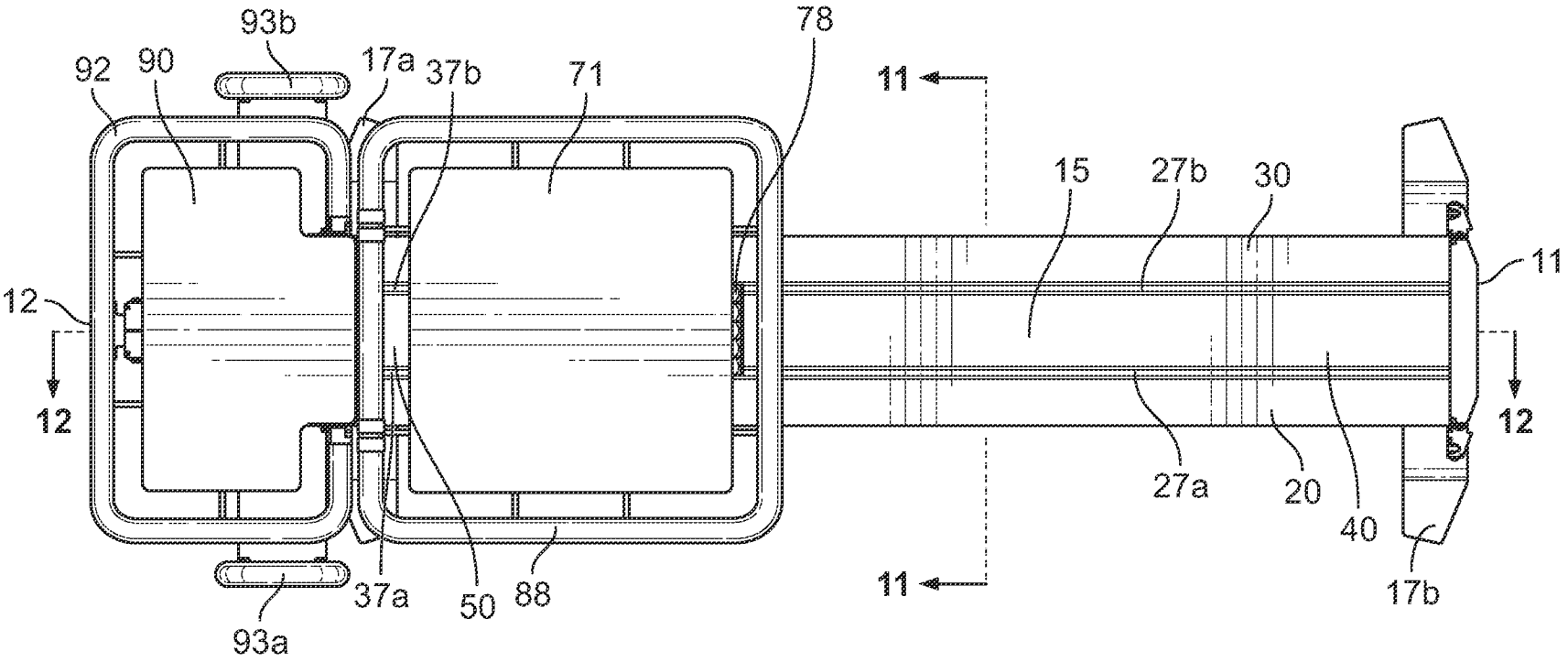
FIG. 6 is a top view of an exercise machine rail system in accordance with an example embodiment.
Figure 7:
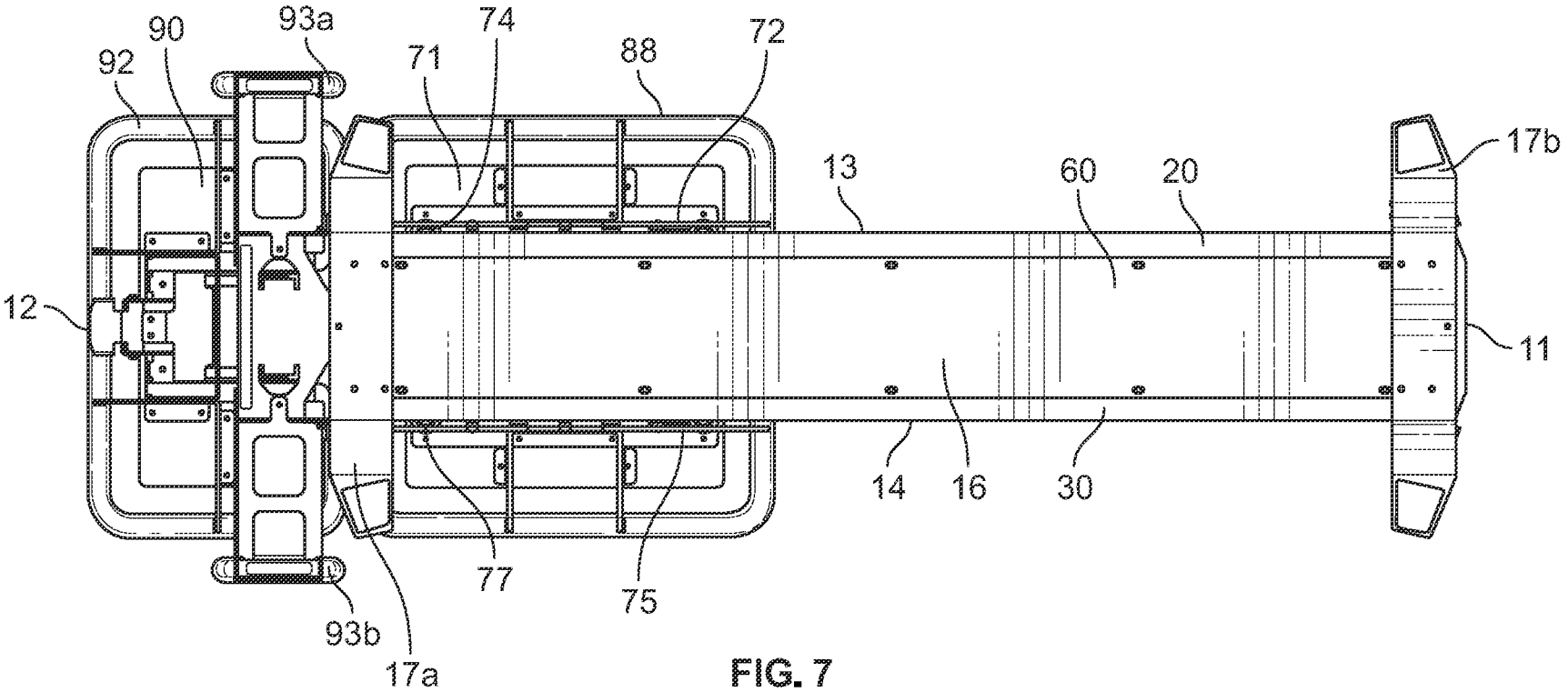
FIG. 7 is a bottom view of an exercise machine rail system in accordance with an example embodiment.

As shown in FIGS. 6 and 7, a first rail 20 may extend between the first and second ends 11, 12 of the exercise machine 10 at or near the first side 13 of the exercise machine 10. The first rail 20 may extend the full length of the exercise machine 10 between the first and second ends 11, 12 thereof, or may extend for less than the full length of the exercise machine 10.

The first rail 20 will generally include a first inner edge 21 and a first outer edge 22, with the first inner edge 21 facing inwardly towards the second rail 30 and the first outer edge 22 facing outwardly away from the second rail 30. The first inner edge 21 of the first rail 20 may include a first inner connector 23 which is adapted to engage with a corresponding first connector 44 of a first spacer 40 and first connector 54 of a second spacer 50 as discussed herein. The first outer edge 22 of the first rail 20 may include a first outer channel 24 which serves as a guide and a track for one or more first wheels 73, 74 so as to allow movement of the carriage 70 along the first rail 20.

Figure 10:
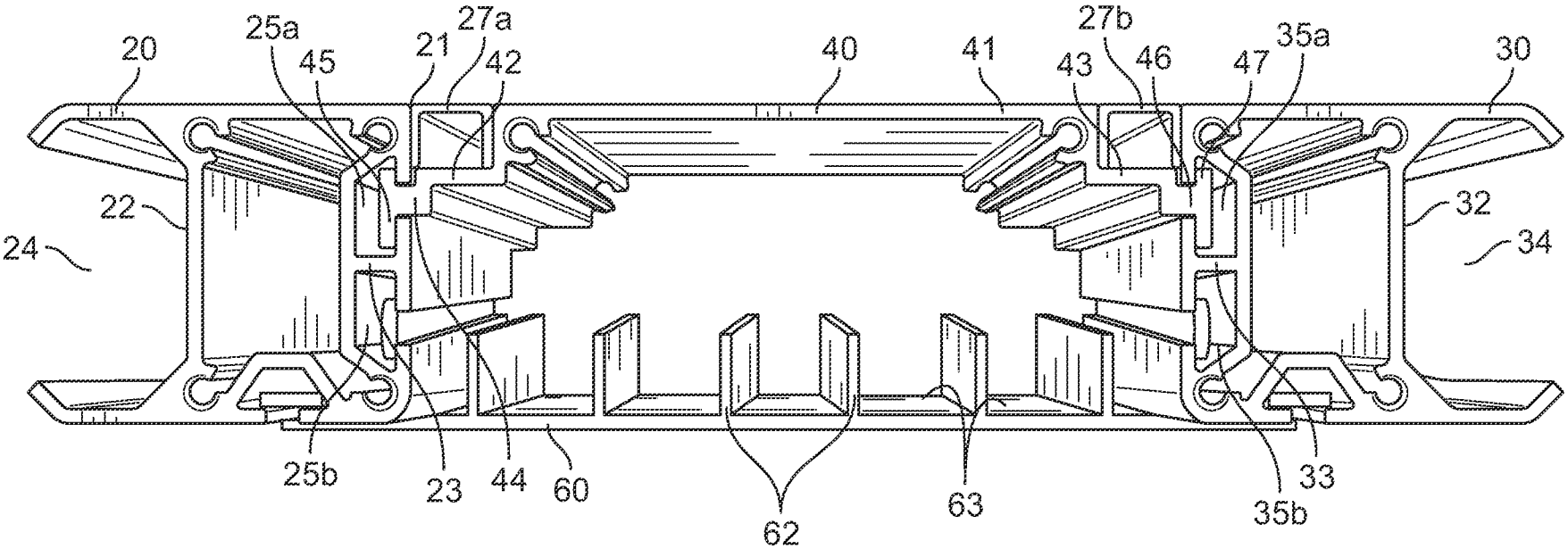
FIG. 10 is an end view of a track of an exercise machine rail system with the end cover and end plate removed in accordance with an example embodiment.

The first inner connector 23 may comprise a T-shaped, elongated member which extends along the length of the first inner edge 21 of the first rail 20 such as shown in FIG. 10. As best shown in FIG. 10, the T-shaped first inner connector 23 may define a pair of slots 25*a*, 25*b* which may be adapted to matingly receive corresponding first connectors 44, 54 of first and second spacers 40, 50. In the embodiment shown in the figures, the T-shaped first inner connector 23 defines an upper slot 25*a* and a lower slot 25*b*, with the first connectors 44, 54 of the first and second spacers 40, 50 engaging within the upper slot 25*a* of the first inner connector 23.

The shape and size of the first inner connector 23 may vary in different embodiments, and should not be construed as limited by the exemplary embodiments shown in the figures. The first inner connector 23 will generally be adapted to matingly engage with the first spacer 40 and second spacer 50, and any type of structure capable of such a mating connection may be utilized for the first inner connector 23.

The first outer channel 24 will generally comprise a channel formed within the first outer edge 22 of the first rail 20 such as shown in FIG. 10. The shape and size of the first outer channel 24 may vary in different embodiments, and should not be construed as limited by the exemplary embodiments shown in the figures. In the exemplary embodiment shown in FIG. 10, it can be seen that the first outer channel 24 may have a reversed C-shape such that the first wheels 73, 74 connected to the carriage 70 may be guided along and may be moved within the first outer channel 24.

As shown in FIGS. 1-7 and 12-17, a second rail 30 may extend between the first and second ends 11, 12 of the exercise machine 10 at or near the second side 14 of the exercise machine 10. The second rail 30 may extend the full length of the exercise machine 10 between the first and second ends 11, 12 thereof, or may extend for less than the full length of the exercise machine 10.

The second rail 30 will generally include a second inner edge 31 and a second outer edge 32, with the second inner edge 31 facing inwardly towards the first rail 20 and the second outer edge 32 facing outwardly away from the first rail 20. The second inner edge 31 of the second rail 30 may include a second inner connector 33 which is adapted to engage with a corresponding second connector 46 of a first spacer 40 and second connector 56 of a second spacer 50 as discussed herein. The second outer edge 32 of the second rail 30 may include a second outer channel 34 which serves as a guide and a track for one or more second wheels 76, 77 so as to allow movement of the carriage 70 along the second rail 30.

The second inner connector 33 may comprise a T-shaped, elongated member which extends along the length of the second inner edge 31 of the second rail 30 such as shown in FIG. 10. As best shown in FIG. 10, the T-shaped second inner connector 33 may define a pair of slots 35*a*, 35*b* which may be adapted to matingly receive corresponding second connectors 46, 56 of first and second spacers 40, 50. In the embodiment shown in the figures, the T-shaped second inner connector 33 defines an upper slot 35*a* and a lower slot 35*b*, with the second connectors 46, 56 of the first and second spacers 40, 50 engaging within the upper slot 35*a* of the second inner connector 33.

The shape and size of the second inner connector 33 may vary in different embodiments, and should not be construed as limited by the exemplary embodiments shown in the figures. The second inner connector 33 will generally be adapted to matingly engage with the first and second spacers 40, 50, and any type of structure capable of such a mating connection may be utilized.

The second outer channel 34 will generally comprise a channel formed within the second outer edge 32 of the second rail 30 such as shown in FIG. 10. The shape and size of the second outer channel 34 may vary in different embodiments, and should not be construed as limited by the exemplary embodiments shown in the figures. In the exemplary embodiment shown in FIG. 10, it can be seen that the second outer channel 34 may have a C-shape such that the second wheels 76, 77 connected to the carriage 70 may be guided along and may be moved within the second outer channel 34.

C. Spacers and Inserts.

As shown throughout the figures, the exercise machine 10 may include one or more spacers 40, 50 which are positioned between the pair of rails 20, 30 such that the pair of rails 20, 30 have the appearance of a monorail. The use of spacers 40, 50 also allows for the overall dimensions of the exercise machine 10 to be easily and efficiently adjusted by simply putting the pair of rails 20, 30 closer together, such as shown in FIGS. 15A, 15B, and 15C, or further apart, such as shown in FIG. 17. In this manner, exercise machines 10 with different dimensions may be easily manufactured without any adjustment to the dimensions or design of the rails 20, 30.

The number of spacers 40, 50 may vary in different embodiments. FIGS. 1A, 1B, and 1C illustrate an embodiment in which a pair of spacers 40, 50 comprising a first spacer 40 and a second spacer 50 are utilized. In such an embodiment, the first spacer 40 and the second spacer 50 are each positioned between the first rail 20 and the second rail 30; with the first spacer 40 being aligned with the second spacer 50. Thus, the first and second spacers 40, 50 may both extend along the same longitudinal axis, with the upper surfaces of the respective spacers 40, 50 being aligned with each other.

Continuing to reference FIGS. 1A, 1B, and 1C it can be seen, in embodiments in which a pair of spacers 40, 50 are utilized, the pair of spacers 40, 50 may be distally spaced-apart along a longitudinal axis so as to define an upper opening 58 between the first spacer 40 and the second spacer 50. The upper opening 58 may be utilized to selectively and removably connect one or more biasing members 80, which extend within the spacers 40, 50, to the carriage 70 so as to impart a variable resistance force against movement of the carriage 70 in one or more directions. The distance between the distal end of the first spacer 40 and the proximal end of the second spacer 50, which defines the size of the upper opening 58, may vary in different embodiments and thus should not be construed as limited by the exemplary embodiment shown in the figures.

As shown in the figures, the first spacer 40 may extend along at least half of the length of the first rail 20 and at least half of the length of the second rail 30. The second spacer 50 may thus extend along less than half of the length of the first rail 20 and less than half of the length of the second rail 30. In such an embodiment, the first spacer 40 is longer than the second spacer 50. However, it should be appreciated that the inverse configuration could be utilized (e.g., the first spacer 40 could in some embodiments be shorter in length than the second spacer 50, with the first spacer 40 extending for less than half of the length of the first and second rails 20, 30 and the second spacer 50 extending for at least half of the length of the first and second rails 20, 30).

By way of example, the first spacer 40 may extend along at least 65% of the length of the first rail 20 and at least 65% of the length of the second rail 30. As a further example, the first spacer 40 may extend along approximately 70% of the length of the first rail 20 and approximately 70% of the length of the second rail 30. As another example, the first spacer 40 may extend along at least 95% of the length of the first rail 20 and at least 95% of the length of the second rail 30.

In some embodiments such as shown in FIG. 1A, the first spacer 40 may extend along the entire length of the first rail 20 and the entire length of the second rail 30. In such embodiments, the second spacer 50 may be omitted entirely. Continuing to reference FIG. 1A, it can be seen that in such an embodiment, an upper opening 58 may be formed within the first spacer 40.

The positioning, size, and orientation of such an upper opening 58 in a single spacer 40 embodiment may vary in different embodiments and should not be construed as limited by the figures. Generally, the upper opening 58 will be positioned adjacent to the resting position of the carriage 70 along the first and second rails 20, 30 such that the one or more biasing members 80 may be easily connected to or disconnected from the carriage 70 through the upper opening 58. By way of example, the upper opening 58 could be positioned at the approximate midpoint of the length of the first spacer 40. As a further example, the upper opening 58 could be positioned at a point along the first half of the length of the first spacer 40. As a further example, the upper opening 58 could be positioned at a point along the second half of the length of the first spacer 40.

The type of material used for the first and second spacers 40, 50 may vary in different embodiments. The spacers 40, 50 may comprise a rigid material, a flexible material, a malleable material, or a semi-rigid material. The spacers 40, 50 may be comprised of various materials, including but not limited to metals, metal alloys, plastics, composites, woods, or the like. In some embodiments, the spacers 40, 50 may comprise a mesh or perforated material, such as but not limited to a mesh metal, a perforated metal, a mesh composite, or a perforated composite.

In some embodiments, the spacers 40, 50 may comprise a solid sheet of material, such as solid sheet metal or solid sheet composite. In embodiments in which a pair of spacers 40, 50 are utilized instead of a single spacer 40, the two spacers 40, 50 may comprise the same material or may comprise different materials. For example, the first spacer 40 could comprise a perforated or mesh material and the second spacer 50 could comprise a solid sheet of material, or vice versa.

1. First Spacer.

As best shown in FIGS. 1A, 1B, 1C, 15A, 15B, 15C, 16, and 17, the exercise machine 10 may include a first spacer 40 which extends between the first rail 20 and the second rail 30. The first spacer 40 will generally be connected on a first side to the first rail 20 and on a second side to the second rail 30. In the exemplary embodiment shown in the figures, the first spacer 40 is connected on its first side to the first inner edge 21 of the first rail 20 and on its second side to the second inner edge 31 of the second rail 30. It should be appreciated that the first spacer 40 may be connected to various other surfaces of the first and second rails 20, 30 in certain embodiments.

It should also be appreciated that the first spacer 40 may be directly connected to the first and second rails 20, 30, such as by use of connectors 54, 56 as shown in the figures, or the first spacer 40 may be indirectly connected to the first and second rails 20, 30, such as but use of a bracket or other type of connecting structure which is positioned between the respective rails 20, 30 and the first spacer 40.

Figure 13:
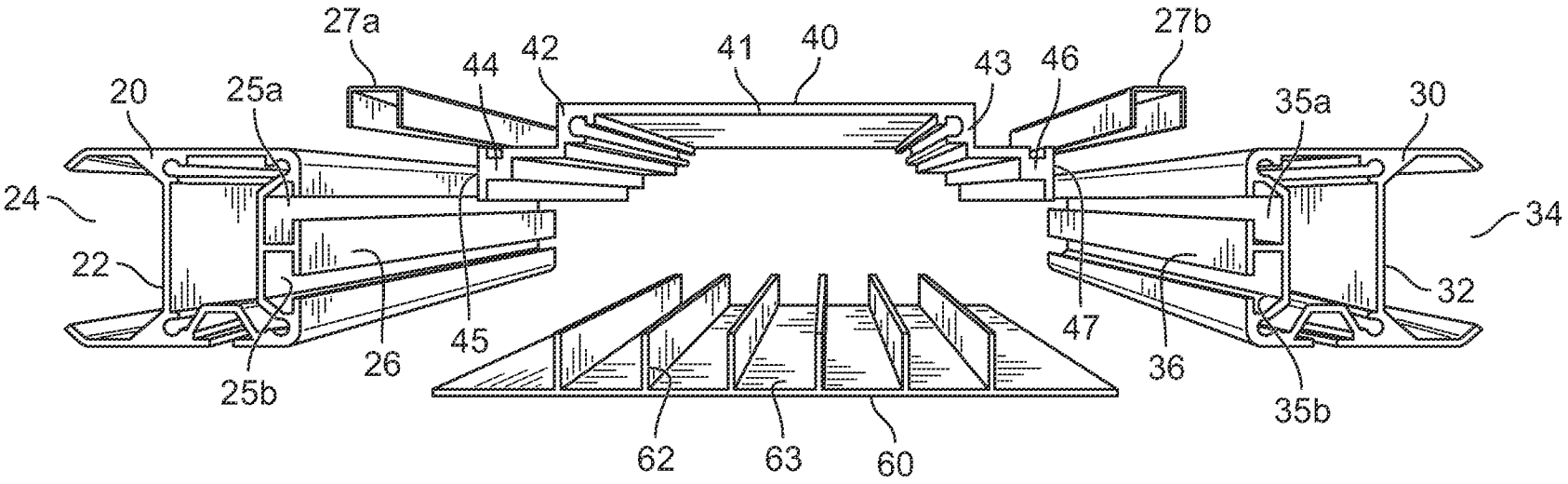
FIG. 13 is an end exploded view of rails and a first spacer of an exercise machine rail system in accordance with an example embodiment.

In the exemplary embodiment best shown in FIG. 13, the first spacer 40 is illustrated as comprising a central portion 41, a first side portion 42 extending from a first side of the central portion 41, and a second side portion 43 extending from a second side of the central portion 41. In such an exemplary embodiment, it can be seen that the first spacer 40 is comprised of an inverted U-shape. It should be appreciated, however, that various other shapes may be utilized for the first spacer 40, and thus that the shape of the first spacer 40 should not be construed as limited by the exemplary embodiment shown in the figures.

Continuing to reference FIG. 13, it can be seen that the first and second side portions 42, 43 each extend substantially downwardly from the central portion 41. More specifically, the first side portion 42 is shown as extending downwardly at an angle from a first side of the central portion 41 and the second side portion 43 is shown as extending downwardly at an angle from a second side of the central portion 41.

The first and second side portions 42, 43 are illustrated as being below the central portion 41. In this manner, the top of the central portion 41 of the first spacer 40 may be flush with the tops of the respective first and second rails 20, 30 such as shown in FIG. 10, with the first and second side portions 42, 43 being concealed and connected with the respective inner edges 21, 31 of the first and second rails 20, 30. Such a configuration allows for the rails 20, 30 and first spacer 40 to appear as a singular, monorail.

In the embodiment shown in the figures, the central portion 41, first side portion 42, and second side portion 43 of the first spacer 40 are shown as being integrally formed of a unitary structure. In some embodiments, the first and second side portions 42, 43 may instead be discrete structures which are connected to the central portion 41. In other embodiments, the first and second side portions 42, 43 may be omitted entirely.

Figure 11:
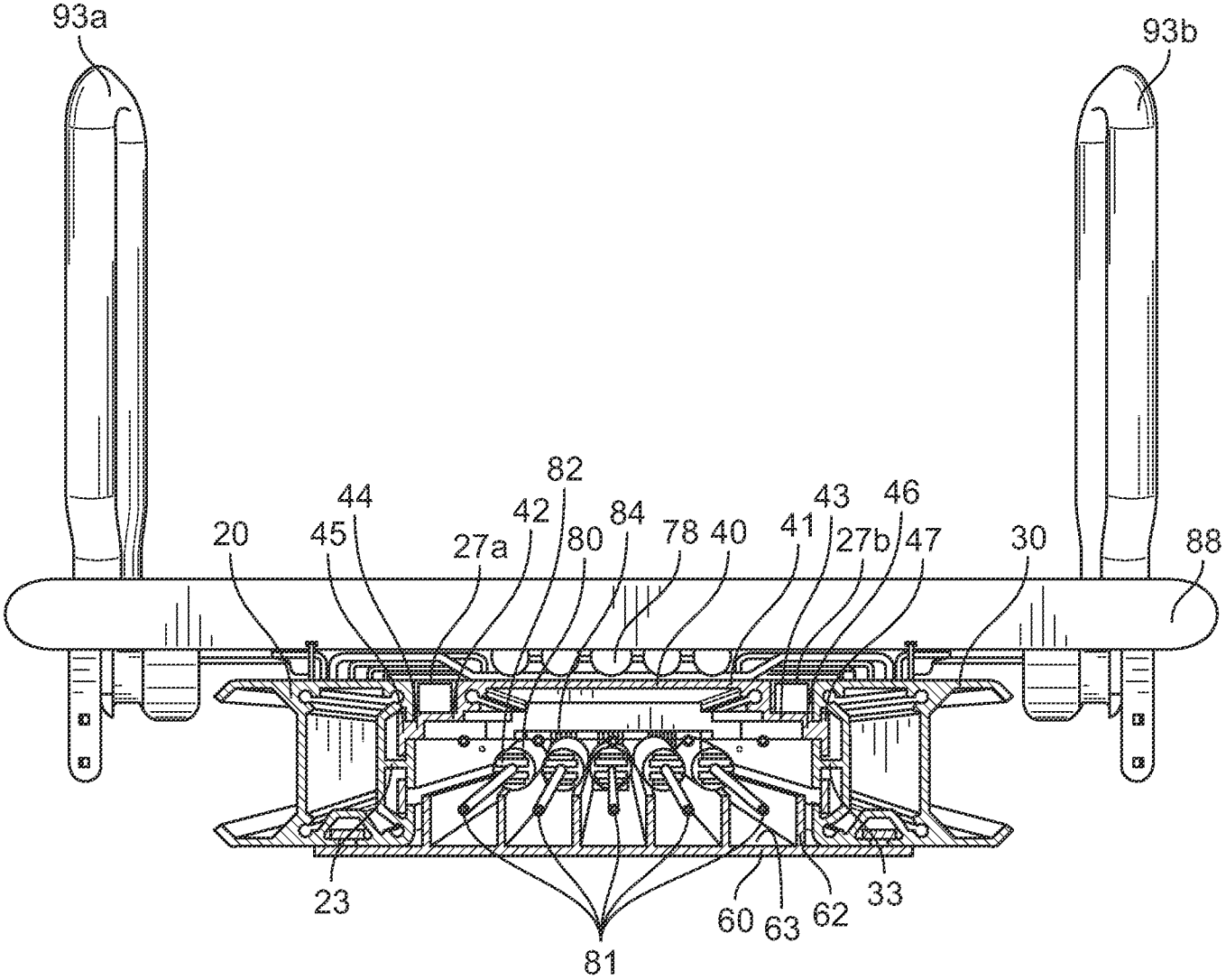
FIG. 11 is a sectional view taken along line 11-11 of FIG. 6.

With reference to FIGS. 10, 11, and 13, it can be seen that the first side portion 42 of the first spacer 40 includes a first connector 44 and that the second side portion 43 of the first spacer 40 includes a second connector 46. The first connector 44 is adapted to connect the first side portion 42 of the first spacer 40 to the first rail 20 and the second connector 46 is adapted to connect the second side portion 43 of the first spacer 40 to the second rail 30. More specifically, in the exemplary embodiment shown in the figures, the first connector 44 is adapted to matingly engage with a corresponding first inner connector 23 on the first inner edge 21 of the first rail 20 and the second connector 46 is adapted to matingly engage with a corresponding second inner connector 33 on the second inner edge 31 of the second rail 30.

Continuing to reference FIGS. 10, 11, and 13, it can be seen that the first connector 44 and the second connector 46 are each comprised of structures adapted to mate with corresponding connectors 23, 33 on the rails 20, 30. In the exemplary embodiment shown in the figures, the first and second connectors 44, 46 of the first spacer 40 are each comprised of a male connector and the first and second inner connectors 23, 33 of the rails 20, 30 are each comprised of a female connector. It should be appreciated that the reverse configuration could be utilized in certain embodiments.

While the figures illustrate that the connectors 44, 46 of the first spacer 40 are comprised of mating structures, it should be appreciated that various other devices and methods may be utilized for interconnecting the first spacer 40 with the first and second rails 20, 30. By way of example and without limitation, it should be appreciated that various clamps, brackets, fasteners, adhesives, magnets, or the like may be utilized to connect the first spacer 40 to the rails 20, 30. In some embodiments, the first spacer 40 may be integral with the rails 20, 30.

With reference to FIGS. 10, 11, and 13, it can be seen that the first connector 44 of the first spacer 40 includes a first flange 45 and that the second connector 46 of the first spacer 40 includes a second flange 47. Each of the flanges 45, 47 may be oriented perpendicular to the respective side portions 42, 43 of the first spacer 40 as shown in the figures. In the exemplary embodiment shown in FIG. 10, it can be seen that the first flange 45 is adapted to slide into and matingly engage with the first upper connector slot 25*a* of the first rail and that the second flange 47 is adapted to slide into and matingly engage with the second upper connector slot 35*a* of the second rail 30. Various other connection points may be utilized. For example, in some embodiments, the flanges 45, 47 may instead be adapted to slide into and matingly engage with the respective lower connector slots 25*b*, 35*b* instead.

2. Second Spacer.

As best shown in FIGS. 1A, 1B, 1C, 15A, 15B, 15C, 16, and 17, the exercise machine 10 may include a second spacer 50 which extends between the first rail 20 and the second rail 30. The second spacer 50 will generally be connected on a first side to the first rail 20 and on a second side to the second rail 30. In the exemplary embodiment shown in the figures, the second spacer 50 is connected on its first side to the first inner edge 21 of the first rail 20 and on its second side to the second inner edge 31 of the second rail 30. It should be appreciated that the second spacer 50 may be connected to various other surfaces of the first and second rails 20, 30 in certain embodiments.

It should also be appreciated that the second spacer 50 may be directly connected to the first and second rails 20, 30, such as by use of connectors 54, 56 as shown in the figures, or the second spacer 50 may be indirectly connected to the first and second rails 20, 30, such as but use of a bracket or other type of connecting structure which is positioned between the respective rails 20, 30 and the second spacer 50.

Figure 14:
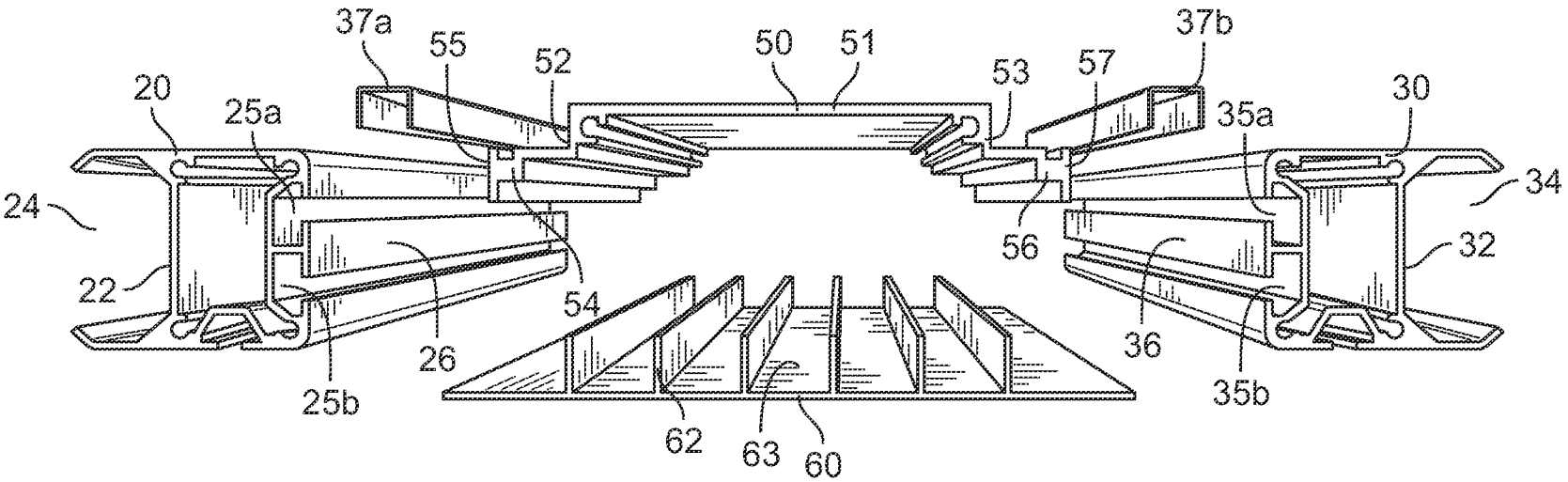
FIG. 14 is an end exploded view of rails and a second spacer of an exercise machine rail system in accordance with an example embodiment.

In the exemplary embodiment best shown in FIG. 14, the second spacer 50 is illustrated as comprising a central portion 51, a first side portion 52 extending from a first side of the central portion 51, and a second side portion 53 extending from a second side of the central portion 51. In such an exemplary embodiment, it can be seen that the second spacer 50 is comprised of an inverted U-shape. It should be appreciated, however, that various other shapes may be utilized for the second spacer 50, and thus that the shape of the second spacer 50 should not be construed as limited by the exemplary embodiment shown in the figures.

Continuing to reference FIG. 14, it can be seen that the first and second side portions 52, 53 each extend substantially downwardly from the central portion 51. More specifically, the first side portion 52 is shown as extending downwardly at an angle from a first side of the central portion 51 and the second side portion 53 is shown as extending downwardly at an angle from a second side of the central portion 51.

The first and second side portions 52, 53 are illustrated as being below the central portion 51. In this manner, the top of the central portion 51 of the second spacer 50 may be flush with the tops of the respective first and second rails 20, 30 such as shown in FIG. 6, with the first and second side portions 52, 53 being concealed and connected with the respective inner edges 21, 31 of the first and second rails 20, 30. Such a configuration allows for the rails 20, 30 and second spacer 50 to appear as a singular, monorail.

In the embodiment shown in the figures, the central portion 51, first side portion 52, and second side portion 53 of the second spacer 50 are shown as being integrally formed of a unitary structure. In some embodiments, the first and second side portions 52, 53 may instead be discrete structures which are connected to the central portion 51. In other embodiments, the first and second side portions 52, 53 may be omitted entirely.

With reference to FIG. 14, it can be seen that the first side portion 52 of the second spacer 50 includes a first connector 54 and that the second side portion 53 of the second spacer 50 includes a second connector 56. The first connector 54 is adapted to connect the first side portion 52 of the second spacer 50 to the first rail 20 and the second connector 56 is adapted to connect the second side portion 53 of the second spacer 50 to the second rail 30. More specifically, in the exemplary embodiment shown in the figures, the first connector 54 is adapted to matingly engage with a corresponding first inner connector 23 on the first inner edge 21 of the first rail 20 and the second connector 56 is adapted to matingly engage with a corresponding second inner connector 33 on the second inner edge 31 of the second rail 30.

Continuing to reference FIG. 14, it can be seen that the first connector 54 and the second connector 56 are each comprised of structures adapted to mate with corresponding connectors 23, 33 on the rails 20, 30. In the exemplary embodiment shown in the figures, the first and second connectors 54, 56 of the second spacer 50 are each comprised of a male connector and the first and second inner connectors 23, 33 of the rails 20, 30 are each comprised of a female connector. It should be appreciated that the reverse configuration could be utilized in certain embodiments.

While the figures illustrate that the connectors 54, 56 of the second spacer 50 are comprised of mating structures, it should be appreciated that various other devices and methods may be utilized for interconnecting the second spacer 50 with the first and second rails 20, 30. By way of example and without limitation, it should be appreciated that various clamps, brackets, fasteners, adhesives, magnets, or the like may be utilized to connect the second spacer 50 to the rails 20, 30. In some embodiments, the second spacer 50 may be integral with the rails 20, 30.

With reference to FIGS. 13 and 14, it can be seen that the first connector 54 of the second spacer 50 includes a first flange 55 and that the second connector 56 of the second spacer 50 includes a second flange 57. Each of the flanges 45, 47 may be oriented perpendicular to the respective side portions 52, 53 of the second spacer 50 as shown in the figures. In the exemplary embodiment shown in FIG. 10, it can be seen that the first flange 55 is adapted to slide into and matingly engage with the first upper connector slot 25*a* of the first rail and that the second flange 57 is adapted to slide into and matingly engage with the second upper connector slot 35*a* of the second rail 30. Various other connection points may be utilized. For example, in some embodiments, the flanges 45, 47 may instead be adapted to slide into and matingly engage with the respective lower connector slots 25*b*, 35*b* instead.

3. Inserts.

As best shown in FIG. 10, the stepped-down configuration of the first and second side portions 42, 43 of the first spacer 40 may form a first gap between the first rail 20 and the first spacer 40 and a second gap between the second rail 30 and the first spacer 40. In such an embodiment, the respective gaps may be filled with first side inserts 27*a*, 27*b* which, when installed to fill the gaps, creates a uniform appearance similar to a monorail.

As best shown in FIGS. 13 and 14, the first side inserts 27*a*, 27*b* may each comprise an elongated member which is positioned within the respective gaps between the rails 20, 30 and the first spacer 40. More specifically, it can be seen that the first side insert 27*a* is inserted and retained within the first gap defined between a first side of the first spacer 40 and the first rail 20 and that the first side insert 27*b* is inserted and retained within the second gap defined between a second side of the first spacer 40 and the second rail 30. In some embodiments, the first spacer 40 and/or rails 20, 30 may be shaped such that no gaps are present, and thus the first side inserts 27*a*, 27*b* are not needed.

Similarly, the stepped-down configuration of the first and second side portions 52, 53 of the second spacer 50 may form a first gap between the first rail 20 and the second spacer 50 and a second gap between the second rail 30 and the second spacer 50. In such an embodiment, the respective gaps may be filled with second side inserts 37*a*, 37*b* which, when installed to fill the gaps, creates a uniform appearance similar to a monorail.

As best shown in FIG. 15A, the second side inserts 37*a*, 37*b* may each comprise an elongated member which is positioned within the respective gaps between the rails 20, 30 and the second spacer 50. More specifically, it can be seen that the second side insert 37*a* is inserted and retained within the first gap defined between a first side of the second spacer 50 and the first rail 20 and that the first side insert 37*b* is inserted and retained within the second gap defined between a second side of the second spacer 50 and the second rail 30. In some embodiments, the second spacer 50 and/or rails 20, 30 may be shaped such that no gaps are present, and thus the second side inserts 37*a*, 37*b* are not needed.

The first and second side inserts 27*a*, 27*b*, 37*a*, 37*b* may each comprise an elongated, rectangular shape. In the exemplary embodiment shown in the figures, the first and second side inserts 27*a*, 27*b*, 37*a*, 37*b* are illustrated as comprising tubular elongated members. More specifically, the first and second side inserts 27*a*, 27*b*, 37*a*, 37*b* may each comprise an inverted U-shaped elongated tubular member as shown in the figures. However, it should be appreciated that other shapes may be utilized for the first and second side inserts 27*a*, 27*b*, 37*a*, 37*b* in different embodiments.

The figures illustrate an embodiment in which the combined length of the first and second side inserts 27*a*, 27*b*, 37*a*, 37*b* are approximately the same length as the combined length of the first and second spacers 40, 50. Thus, each of the first side inserts 27*a*, 27*b* are both the same length as each other and the same length as the first spacer 40. Similarly, each of the second side inserts 37*a*, 37*b* are both the same length as each other and the same length as the second spacer 50. In some embodiments, the first side inserts 27*a*, 27*b* may be shorter or longer than the first spacer 40, and the second side inserts 37*a*, 37*b* may be shorter or longer than the second spacer 50.

In embodiments in which only a single spacer 40 is utilized, such as the embodiment shown in FIGS. 15B and 15C, only first side inserts 27*a*, 27*b* may be utilized. In yet other embodiments, only a pair of first side inserts 27*a*, 27*b* may be utilized which are each the same length as the combined length of the first and second spacers 40, 50. In such embodiments, second side inserts 37*a*, 37*b* may be omitted.

D. Lower Member.

As shown throughout the figures, the exercise machine 10 may include a lower member 60 which is connected between the first rail 20 and the second rail 30 below the first and second spacers 40, 50 so as to enclose the gap between the first and second rails 20, 30. The lower member 60 may comprise an elongated member which extends at its width between the rails 20, 30 and at its length between the ends 11, 12 of the exercise machine 10. In this manner, the bottom of the rails 20, 30 may be covered so as to prevent damage or injury.

The lower member 60 may comprise a flat, plate-like, elongated member as shown in the figures. The first and second rails 20, 30 may rest upon the lower member 60 such as shown in FIGS. 8-11. The lower member 60 may be connected to the rails 20, 30 by various methods, such as but not limited to the use of fasteners, anchors, clamps, adhesives, welding, magnets, mating connectors, or the like.

The lower member 60 will generally have a length that is equal to or greater than the combined length of the first and second spacers 40, 50 such that the lower member 60 extends for the combined length of the first and second spacers 40, 50. While the figures illustrate the use of a single, unitary lower member 60, it should be appreciated that, in some embodiments, multiple lower members 60 may be interconnected. For example, in some embodiments, each of the first and second spacers 40, 50 may have its own lower member 60, with such lower members 60 being interconnected to form a unitary member.

As best shown in FIGS. 8-11, the lower member 60 may include a plurality of dividers 62 extending along its upper surface between its first and second ends. The dividers 62 may comprise elongated, raised members such as ribs or the like which define a plurality of channels 63. The dividers 62 may comprise parallel, distally-spaced ribs such as shown in the figures, with the channels 63 being defined between adjacent pairs of dividers 62.

One or more of the elongated members 81 may extend through each of the plurality of channels 63 such as shown in FIG. 11. In embodiments in which biasing members 80 are directly connected to the carriage 70, the one or more biasing members 80 may be positioned within each of the plurality of channels 63. In some embodiments, the dividers 62 may be omitted, and thus no such channels 63 may be defined. In other embodiments, the lower member 60 may be omitted entirely.

E. Carriage.

As shown throughout the figures, the exercise machine 10 generally includes a carriage 70 which is movably positioned upon the first and second rails 20, 30 such that the carriage 70 may move along at least a portion of the length of the first and second rails 20, 30. In an exemplary embodiment, the carriage 70 is adapted to move back and forth along at least a portion of the length of the first and second rails 20, 30 in a reciprocating manner. The carriage 70 typically includes a plurality of wheels 73, 74, 76, 77 or other movable structures that movably engage with the first and second rails 20, 30 of the exercise machine 10.

In an exemplary embodiment such as shown in FIG. 1A, the carriage 70 is illustrated as comprising platform 71 at its upper end. An exerciser will generally positioned one or more body parts on the upper surface of the platform 71 when performing various exercise moves. The lower surface of the carriage 70 may be positioned over the first and second rails 20, 30, which function as a track for the carriage 70 to move along.

The carriage 70 may include various handles, cutouts, and the like which an exerciser may grasp or contact with various limbs during the performance of a wide range of exercises. In the exemplary embodiment shown in FIG. 1A, the carriage 70 is shown as including a perimeter handle 88 surrounding the carriage 70. It should be appreciated that such a configuration is merely for exemplary purposes, and thus should not be construed as limiting in scope.

The shape, size, and configuration of the carriage 70 may vary in different embodiments, and thus should not be construed as limited by the exemplary embodiments shown in the figures. The carriage 70 will generally comprise a substantially-rectangular shape such as shown in the figures, though other shapes may be utilized in different embodiments. The length and width of the carriage 70 may vary depending on the embodiment so as to suit different types of exercisers. A large bodybuilder would benefit from a longer and wider carriage 70 than a more cardio-based exerciser with perhaps a smaller stature. Thus, the dimensions of the carriage 70 shown in the exemplary figures should not be construed as limiting in scope.

U.S. Pat. Nos. 10,716,964, 10,155,129, 9,604,095, 9,579,555 and 7,803,095 disclose example exercise machines with a movable carriage, the entire disclosures of which, except for any definitions, disclaimers, disavowals, and inconsistencies, are incorporated herein by reference.

As shown in the figures, the carriage 70 will generally be movably positioned or connected to the first and second rails 20, 30. The manner in which the carriage 70 is movably positioned or connected to the first and second rails 20, 30 may vary in different embodiments. In some embodiments, portions of the carriage 70 may mate with the first and second rails 20, 30 such that the carriage 70 may slide upon the first and second rails 20, 30. In other embodiments, magnets such as magnetic levitation may be utilized.

Figure 4:
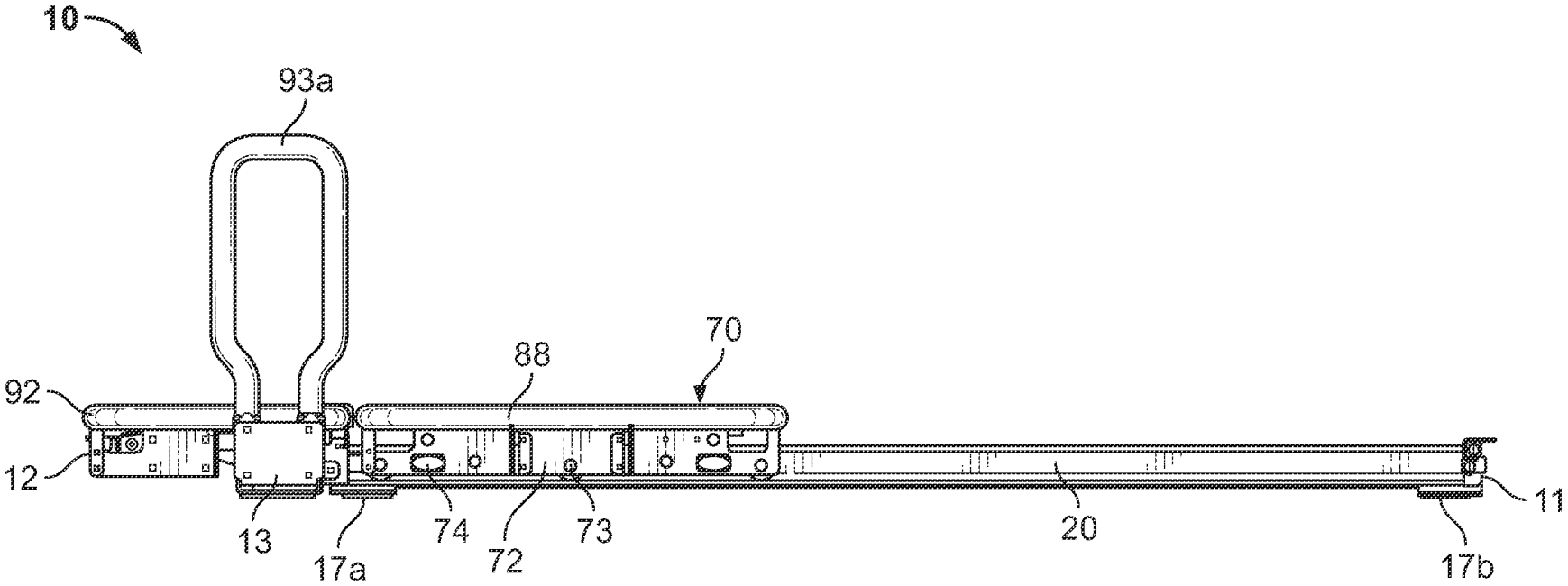
FIG. 4 is a first side view of an exercise machine rail system in accordance with an example embodiment.
Figure 5:
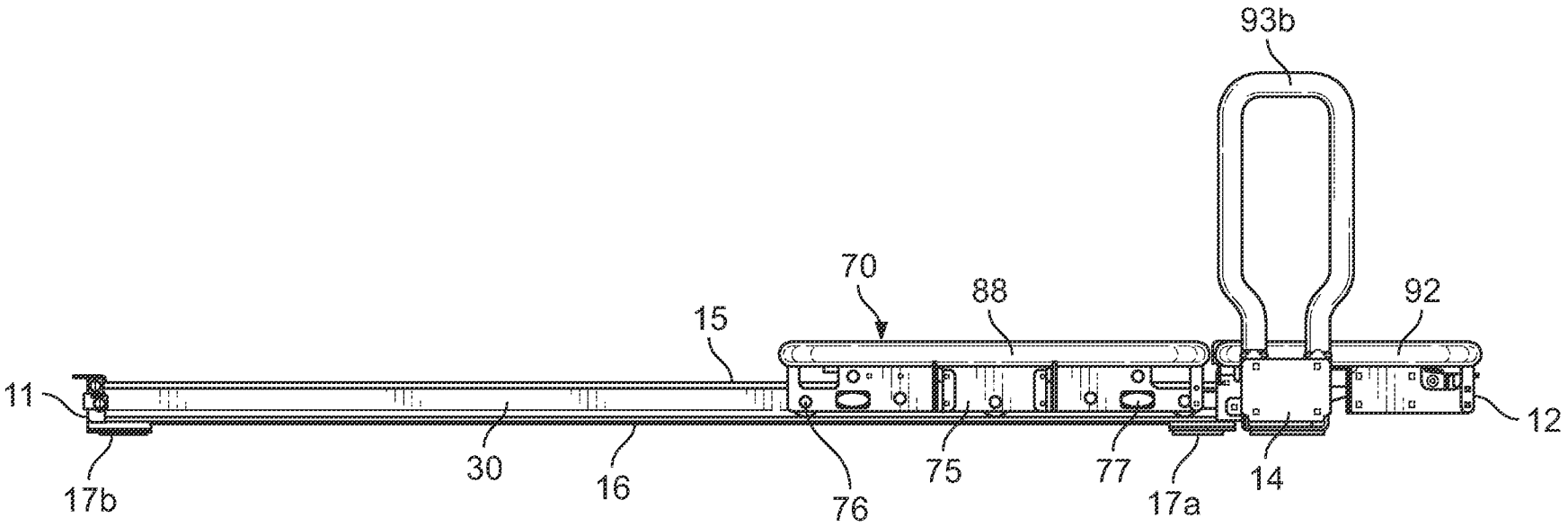
FIG. 5 is a second side view of an exercise machine rail system in accordance with an example embodiment.

In the exemplary embodiment best shown in FIGS. 4 and 5, the carriage 70 is illustrated as comprising a plurality of wheels 73, 74, 76, 77 which are each adapted to rotate along the first and second rails 20, 30 such that the carriage 70 moves along the first and second rails 20, 30 in one or more directions. More specifically, the carriage 70 may include a plurality of wheels 73, 74, 76, 77 which each engage within the respective channels 24, 34 of the rails 20, 30.

As best shown in FIGS. 4 and 5, the carriage 70 may include a first wheel support 72 and a second wheel support 75. In such an exemplary embodiment, the first wheel support 72 extends downwardly from a first side of the carriage 70 and the second wheel support 75 extends downwardly from a second side of the carriage 70. The wheel supports 72, 75 may extend vertically downwardly, or may extend downwardly at an angle (e.g., angled towards or away from the rails 20, 30). Each of the wheel supports 72, 75 may comprise one or more brackets to which one or more wheels 73, 74, 76, 77 may be rotatably connected.

In the exemplary embodiment shown in FIG. 4, it can be seen that the carriage 70 includes a first wheel support 72 extending downwardly from a first side of the carriage 70. The first wheel support 72 includes a plurality of wheels 73, 74 which are adapted to roll along the first outer channel 24 of the first rail 20. In the exemplary embodiment shown in FIG. 4, it can be seen that the first wheel support 72 includes a combination of first vertical wheels 73 and first horizontal wheels 74. It should be appreciated that, in some embodiments, only vertical wheels 73 or only horizontal wheels 74 may be utilized.

The first vertical wheels 73 engage with the top or bottom of the first outer channel 24 of the first rail 20. The first horizontal wheels 74 engage with the inner side of the first outer channel 24 of the first rail 20. Although not shown, in some embodiments, diagonal wheels may be utilized in combination with or instead of horizontal and/or vertical wheels 73, 74. The figures illustrate an embodiment which includes five vertical wheels 73 and two horizontal wheels 74. It should be appreciated that such an embodiment is merely for illustrational purposes, as the first wheel support 72 may include more or less wheels 73, 74 than shown in the exemplary figures.

In the exemplary embodiment shown in FIG. 5, it can be seen that the carriage 70 includes a second wheel support 75 extending downwardly from a second side of the carriage 70. The second wheel support 75 includes a plurality of wheels 76, 77 which are adapted to roll along the second outer channel 34 of the second rail 30. In the exemplary embodiment shown in FIG. 5, it can be seen that the second wheel support 75 includes a combination of first vertical wheels 76 and first horizontal wheels 77. It should be appreciated that, in some embodiments, only vertical wheels 76 or only horizontal wheels 77 may be utilized.

The second vertical wheels 76 engage with the top or bottom of the second outer channel 34 of the second rail 30. The second horizontal wheels 77 engage with the inner side of the second outer channel 34 of the second rail 30. Although not shown, in some embodiments, diagonal wheels may be utilized in combination with or instead of horizontal and/or vertical wheels 76, 77. The figures illustrate an embodiment which includes five vertical wheels 76 and two horizontal wheels 77. It should be appreciated that such an embodiment is merely for illustrational purposes, as the second wheel support 75 may include more or less wheels 76, 77 than shown in the exemplary figures.

Figure 8:
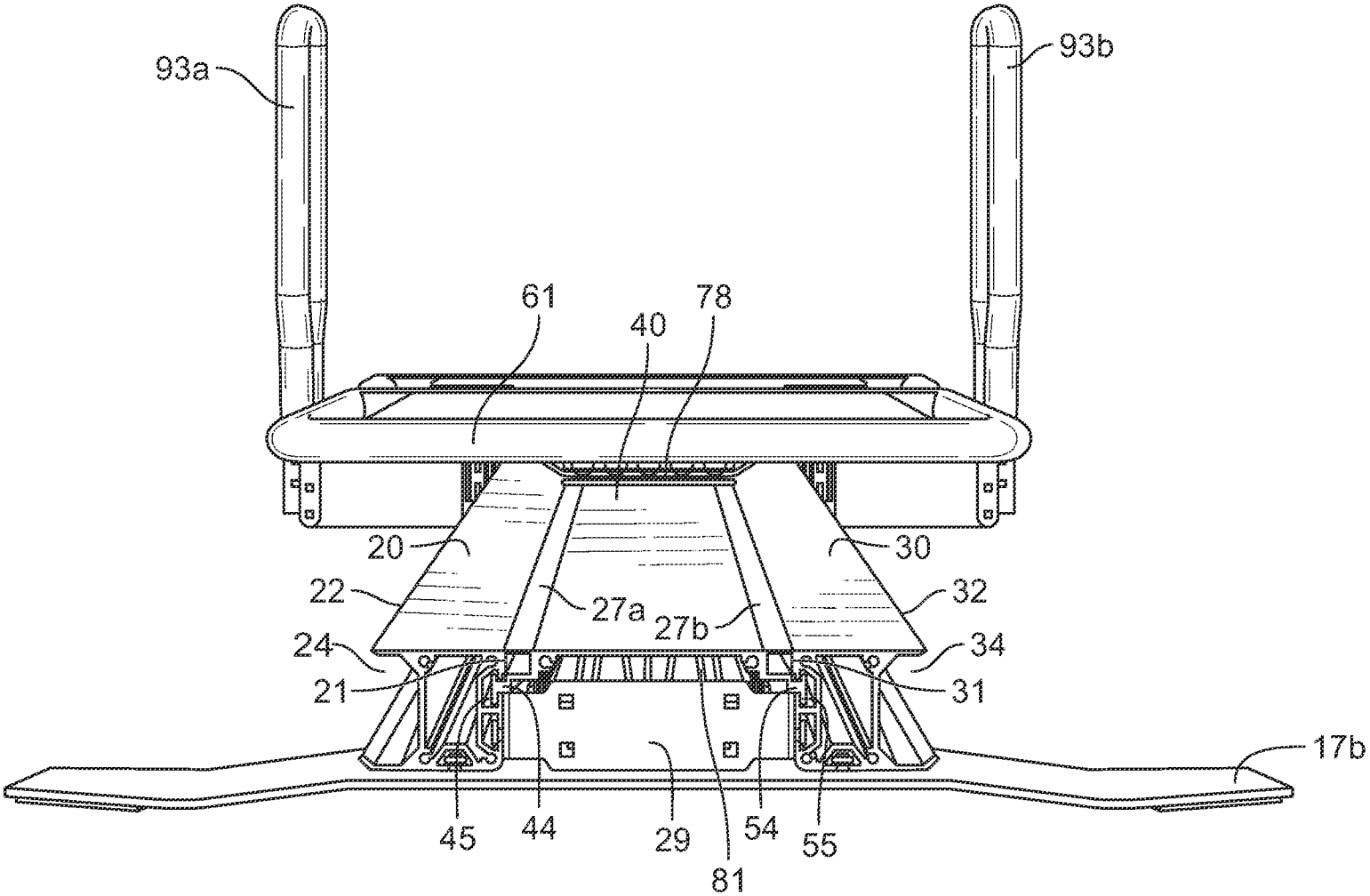
FIG. 8 is an end perspective view of an exercise machine rail system with the end cover removed in accordance with an example embodiment.
Figure 9:
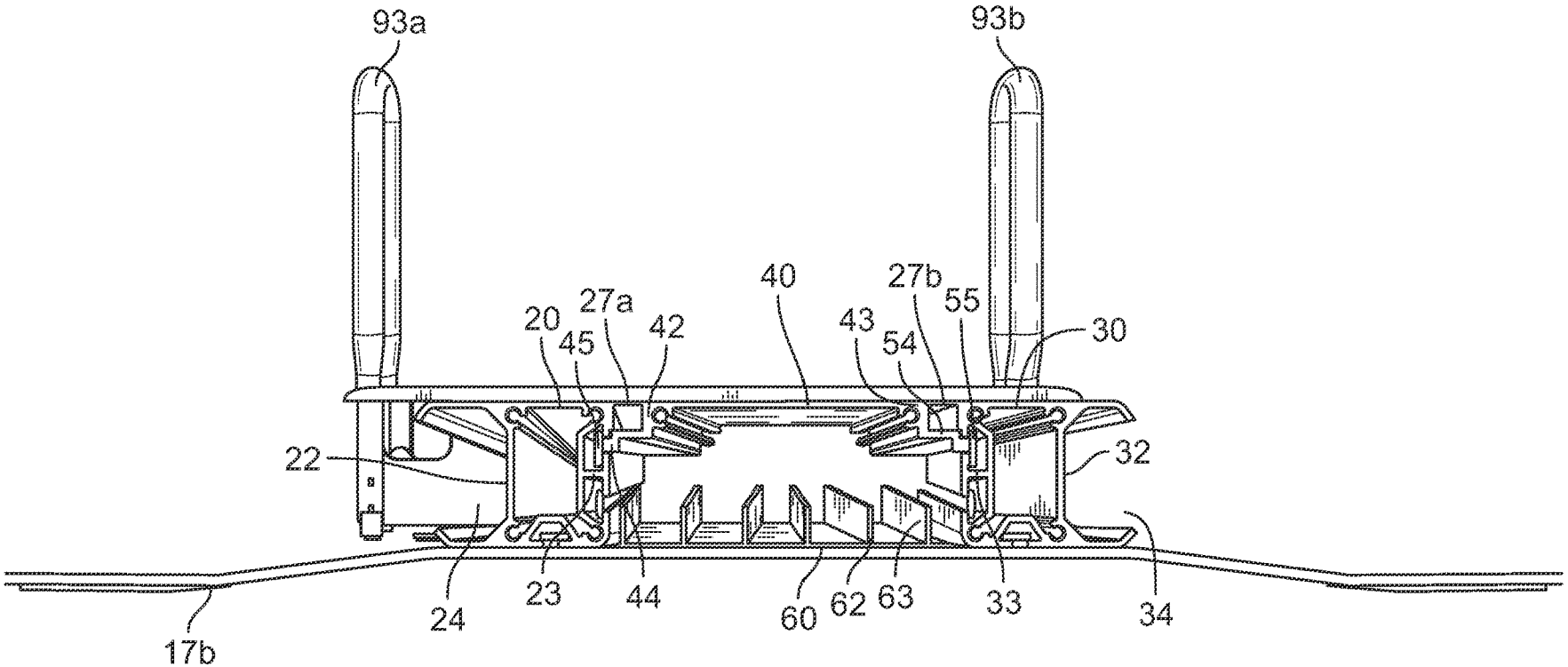
FIG. 9 is an end view of an exercise machine rail system with the end cover removed in accordance with an example embodiment.

As best shown in FIGS. 6 and 8, the carriage 70 may include one or more biasing selectors 78 to which one or more biasing members 80 may be selectively and removably connected so as to impart a variable resistance force against movement of the carriage 70 in one or more directions. In the exemplary figures, the resistance selectors 78 are shown as being connected to a leading end of the carriage 70. The shape, size, orientation, and configuration of the resistance selectors 78 may vary in different embodiments, and thus should not be construed as limited by the exemplary figures. U.S. Pat. No. 10,994,168 discloses an example exercise machine with a resistance selector system, the entire disclosure of which, except for any definitions, disclaimers, disavowals, and inconsistencies, is incorporated herein by reference.

F. Biasing/Elongated Members.

As shown in the figures, one or more biasing members 80 may be connected (e.g., directly or indirectly) to the carriage 70 so as to apply a variable or fixed, linear or non-linear force (e.g., a bias/resistance/tension force) to resist movement of the carriage 70 in one or more directions. The one or more biasing members 80 may also provide an equal or non-equal force in the direction of movement of the carriage 70 to assist the movement of the carriage 70 in one or more directions. The biasing members 80 may comprise various devices, assemblies, systems, subsystems, units, and the like capable of imparting a force against an object.

Figure 12:
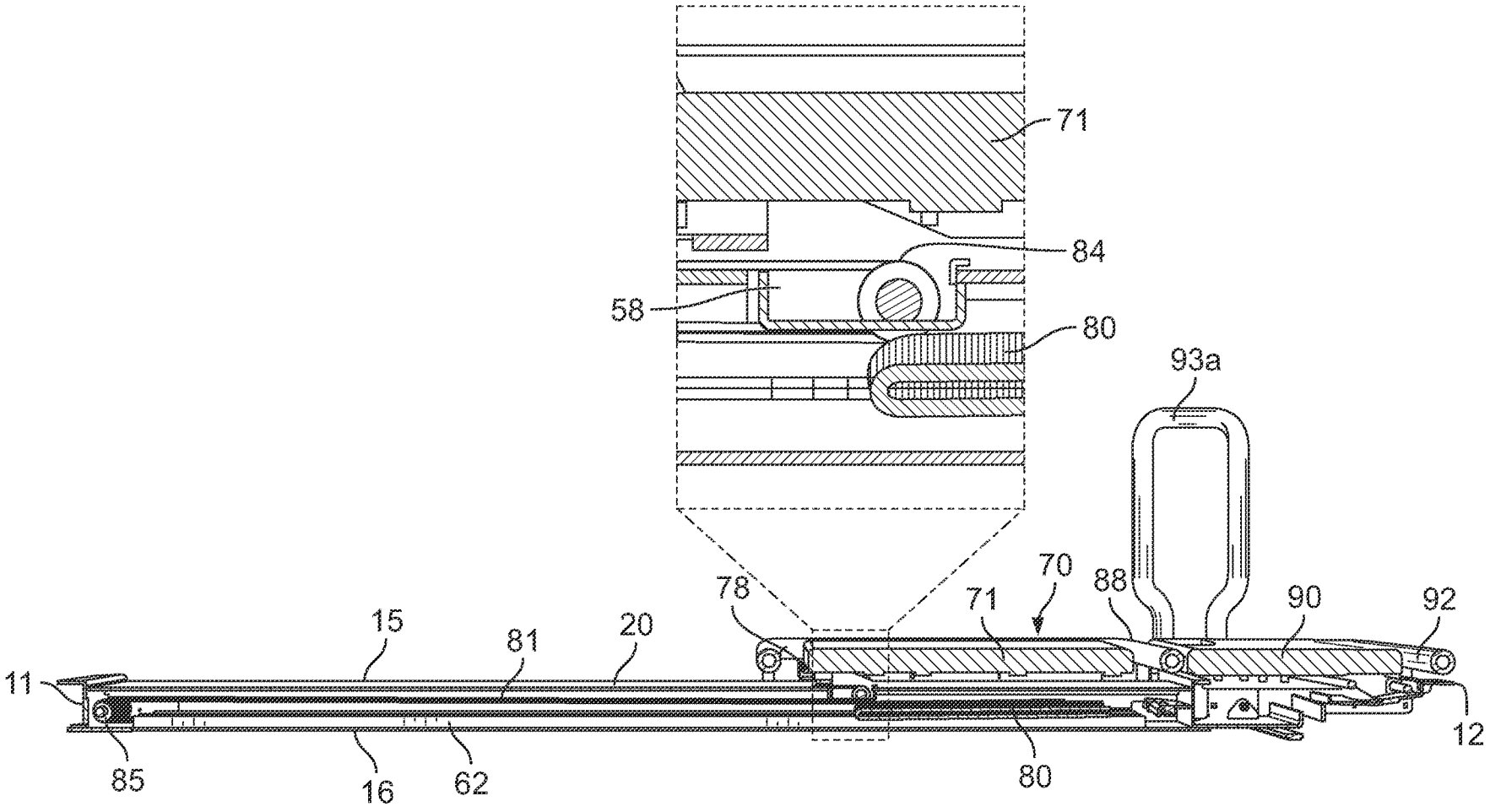
FIG. 12 is a sectional view taken along line 12-12 of FIG. 6.

In the embodiment best shown in FIG. 12, it can be seen that the biasing members 80 are indirectly connected to the carriage 70 by use of one or more elongated members 81. More specifically, each elongated member 81, which may be comprised of various configurations including but not limited to ropes, cords, strings, and the like, is wound around one of a plurality of first pulleys 84 and one of a plurality of second pulleys 85. Each elongated member 81 may be selectively and removably connected to the carriage 70 and may be selectively and removably connected to one or more biasing members 80.

In the embodiment shown in the figures, it can be seen that one or more elongated members 81 are wound around a pair of pulleys 84, 85. A first set of pulleys 84 is positioned underneath the resting position of the carriage 70 such that the first set of pulleys 84 is positioned below the upper opening 58. As shown in FIG. 1B, the first set of pulleys 84 may thus extend partially out of the upper opening 58. However, in some embodiments, the first set of pulleys 84 may instead be inset with respect to the upper opening 58, with the first set of pulleys 84 not extending out of the top of the upper opening 58.

In the exemplary figures, a second set of pulleys 85 is shown positioned near the first end 11 of the exercise machine 10, with the elongated members 81 being wound around both the first set of pulleys 84 underneath the upper opening 58 and the second set of pulleys 85 at the first end 11 of the exercise machine 10.

A plurality of biasing members 80 are shown positioned adjacent to the elongated members 81, with the biasing members 80 being positioned between the carriage 70 and the second end 12 of the exercise machine 10. In some embodiments, each of the elongated members 81 may be selectively and removably engaged with one or more of the biasing members 80 and to the carriage 70 (e.g., to the resistance selectors 78 of the carriage 70) such that variable levels of resistance may be applied against movement of the carriage 70 in one or more directions.

The biasing force applied by each of the biasing members 80 may be a linear force or a non-linear force. The total force applied to the carriage 70 by each of the biasing members 80 may be adjusted by the number of biasing members 80 connected to the carriage 70 being changed. The connection of more biasing members 80 will increase the total force applied to the carriage 70, and the connection of less biasing members 80 will decrease the total force applied to the carriage 70. Thus, by connecting additional biasing members 80 to the carriage 70, the total force applied to the carriage 70 will increase. By removing biasing members 80 from the carriage 70, the total force applied to the carriage 70 will decrease.

Each biasing member 80 may provide a constant force or a variable force to the carriage 70. Each of the biasing members 80 may also provide the same force or a different force to the carriage 70. Each of the one or more biasing members 80 may be configured to provide the same force, with each biasing member 80 providing a uniform force. Thus, each of the biasing members 80 may be comprised of the same size, same type, same length, and same force (e.g., 5 pounds force in a resting position and 10 pounds force in a stretched position). Each biasing member 80 may be comprised of one or more elongated elastic objects such as utilizing two tension coil springs together to form a single biasing member 80.

Alternatively, the one or more biasing members 80 may be configured to each provide a different force, with one or more of the biasing members 80 providing a different force than one of more of the other biasing members 80. In some embodiments, multiple biasing members 80 may provide the same force, while other biasing members 80 may provide a different force than the remaining biasing members 80. As an example, a first biasing member 80 may be comprised of a tension coil spring having an initial tension force of 3 pounds and a stretched tension force of 5 pounds and a second biasing member 80 may be comprised of a tension coil spring having an initial tension force of 6 pounds and a stretched tension force of 10 pounds, which allows for incremental adjustment of the tension force applied to the carriage 70. As a further example, a third biasing member 80 may have a different force compared to the first and second biasing members 80. In some embodiments, the amount of force for each of the biasing members 80 may be indicated by various indicia, such as by color-coding, illumination, tactile feedback, audible sounds, or the use of visual indicia such as symbols and/or text.

By way of a further example, a first biasing member 80 may be adapted to apply 1 pound of force, a second biasing member 80 may be adapted to apply 5 pounds of force, a third biasing member 80 may be adapted to apply 15 pounds of force, and a fourth biasing member 80 may be adapted to apply 20 pounds of force. By connecting the first and third biasing member 80 to the carriage 70, the total force applied to the carriage 70 will be 16 pounds. As a further example, connecting the second and fourth biasing members 80 to the carriage 70 will result in a total force of 25 pounds being applied to the carriage 70. Various other combinations may be utilized, and thus the preceding exemplary illustrations should not be construed as limiting in scope.

Generally, the amount of force applied to the carriage 70 (e.g., the amount of bias force experienced by the carriage 70) will be a function of the inherent characteristics of the biasing member 80 being utilized. For example, such inherent characteristics may include, without limitation, the type, material, length, diameter, pitch, number of winds, spring constant, frequency of compression, etc. of the particular biasing members 80 being utilized. Further, the amount of force applied to the carriage 70 will depend upon the length of the connected biasing members 80, the motion of the biasing members 80, and the number of biasing members 80 connected to the carriage 70 at a particular time.

If each of the biasing members 80 has the same inherent characteristics, then the connection of ten biasing members 80 to the carriage 70 will generate ten times the amount of force as if only one biasing member 80 was connected. If each of the biasing members 80 has different inherent characteristics, then the force can be adjusted by connecting different combinations of biasing members 80 to the carriage 70. Thus, there are large variations in force that can be applied to the carriage 70 by modifying a variety of variables including the number of connected biasing members 80.

The biasing member 80 may comprise one or more connected components providing a mechanism for creating a preferred force of an exercise machine 10 against which an exerciser must generally apply a muscle force greater than the biasing member 80 force in order to move a component (e.g., the carriage 70) in a direction opposed to the direction of the force.

The type of biasing member 80 utilized may vary in different embodiments, including but not limited to electronic resistance devices, magnetic resistance devices, electromagnetic resistance devices, electric motor resistance devices (e.g., a motor such as a servo motor or stepped motor), various types of springs (e.g. linear springs, non-linear springs, coil springs, tension springs, compression springs, spring tethers, extension springs, torsion springs, metal springs, non-metal springs, etc.), various types of elastic members (e.g. elastic bands, rubber bands, resistance bands, elastic shock cords, elastomer members, viscous members, resistance tubes), various weights, dashpots, eddy current breaks, friction blocks, pneumatic members, and/or any other member/device/system capable of creating linear or non-linear forces upon the carriage 70.

Each of the biasing members 80 may be comprised of a linkage member (e.g. elongated member, cable, rope, arm, cord, wire, bar, etc.) that is connected to and transfers a force from a resistance device such as but not limited to a magnetic resistance device, electrical-mechanical resistance device, electromagnetic resistance device, electronic resistance device, electric motor resistance device, fan-based resistance device, fluid-based resistance device, mechanical resistance device, or direct contact resistance device. Any such linkage member may be rigid, flexible, elastic, resilient, etc. The resistance device may provide a constant force, a variable force or a user-selected adjustable force that is transferred to the carriage 70.

Any of the aforementioned types of biasing members 80 may be connected to a cable or linkage that redirects a force of one or more resistance-inducing components to a movable component (e.g., the carriage 70) used by an exerciser for performing an exercise against the resistance.

In some embodiments, the one or more biasing members 80 may be permanently affixed to the carriage 70. In other embodiments, one or more biasing members 80 may be removably and selectively attached to the carriage 70 such that a variable level of force may be applied to movement of the carriage 70 upon the first and second rails 20, 30 depending on the number of such biasing members 80 attached.

The one or more biasing members 80 may each have a first end attached to a fixed component of the exercise machine 10 and a second end that is adapted for selectively connecting to a movable component of the exercise machine 10 (e.g., the carriage 70), thereby allowing for adjustment of the force applied to the movable component of the exercise machine 10. The second end of the one or more biasing members 80 is opposite of the first end of the one or more biasing members 80. Each of the biasing members 80 may have various cross-sectional shapes (e.g., circular, square-shaped, etc.) and various initial contracted lengths (e.g., 3 feet, 4 feet, etc.).

In some embodiments in which the biasing members 80 are directly connected to the carriage 70, the exercise machine 10 may include one or more biasing members 80 which are connected to the carriage 70 so as to provide a force against movement of the carriage 70 in at least a first direction and in favor of movement of the carriage 70 in at least a second direction opposite to the first direction. Generally, the first end of each biasing member 80 will be anchored, such as by being coupled with the exercise machine 10 (e.g., to a structural element of the frame 25), with the second end of each biasing member 80 being removably and selectively coupled to the carriage 70, such as by use of a resistance selector device or manually by hand.

In embodiments such as shown in the figures, a first end of each biasing member 80 may be anchored to the exercise machine 10, and a second end of each biasing member 80 may be selectively and removably connected to one or more of the elongated members 81 so as to impart resistance force against movement of the carriage 70. However, various structures and methods may be utilized to selectively and removably connect one or more of the biasing members 80 directly to the carriage 70, including but not limited to the use of magnets, latches, clamps, clasps, fasteners, adhesives, and the like.

G. End Platform.

As shown in FIGS. 1A, 1B, and 4-7, the exercise machine 10 may include one or more end platforms 90 on which various portions of an exerciser's body may be positioned while performing various types of exercise movements. The figures illustrate the use of a single end platform 90 positioned at or near a second end 12 of the exercise machine 10. In some embodiments, the first end 11 of the exercise machine 10 may also include an end platform 90. The exercise machine 10 may thus not have any end platforms, or the exercise machine 10 may have one end platform 90 such as shown in the figures, or the exercise machine 10 may have a pair of end platforms 90.

The shape, orientation, size, and positioning of the end platform 90 may vary in different embodiments. The end platform 90 will generally include a first end and a second end. The first end of the end platform 90 will generally face towards the carriage 70 and the second end of the end platform 90 will generally face away from the carriage 70.

The manner in which the end platform 90 is connected to the exercise machine 10 may vary. The end platform 90 may be connected directly to the frame of the exercise machine 10. The end platform 90 may be connected both to the frame and to the rails 20, 30. In some embodiments, the end platform 90 may be connected to the frame, the rails 20, 30, and/or to any other structural element of the exercise machine 10.

The end platform 90 may include various cutouts or gripping surfaces which an exerciser may contact with various body parts during performance of various exercise moves. The end platform 90 may include one or more handles 92, 93*a*, 93*b* to aid in performing various exercise moves, or to aid in mounting or dismounting the exercise machine 10.

In the exemplary embodiment shown in the figures, the end platform 90 is illustrated as including a perimeter handle 92 which substantially surrounds the end platform 90 as best shown in FIGS. 1A and 1B. The perimeter handle 92 is distally-spaced with respect to the outer edges of the end platform 90 so as to define a gap or opening in which an exercise may place various body parts during performance of various exercise movements. Additionally, the embodiment shown in FIGS. 1A and 1B illustrates that the end platform 90 includes a pair of side handles 93*a*, 93*b* which extend upwardly from the end platform 90 on either side of the end platform 90. Thus, a first side handle 93*a* extends upwardly from a first side of the end platform 90 and a second side handle 93*b* extends upwardly from a second side of the end platform 90. Various other handle configurations may be utilized for the end platform 90, or the end platform 90 may not include handles at all, in some embodiments.

H. Operation of Preferred Embodiment.

The exercise machine 10 may be manufactured to suit various different exercisers and exercise spaces (e.g., a room or a studio) without substantially modifying the design of the exercise machine 10. FIGS. 15A, 15B, and 15C illustrate an exemplary exercise machine 10 in which the rails 20, 30 are further apart, with wider spacers 40, 50 separating the rails 20, 30. Such an embodiment may be suitable for wider exercise spaces or larger exercisers which require more support for the carriage 70. FIG. 17 illustrates an exemplary exercise machine 10 in which the rails 20, 30 are closer together, with narrower spacers 40, 50 separating the rails 20, 30. Such an embodiment may be suitable for narrower exercise spaces or smaller exercisers which require less support for the carriage 70.

In manufacturing the exercise machine 10, the first and second rails 20, 30 will generally be positioned parallel to each other, such as by placing the rails 20, 30 on a lower member 60 or connecting the rails 20, 30 to the lower member 60. The first and second spacers 40, 50 may then be installed between the rails 20, 30 so as to interconnect the rails 20, 30 and form a monorail configuration as shown in the figures.

Figure 2:
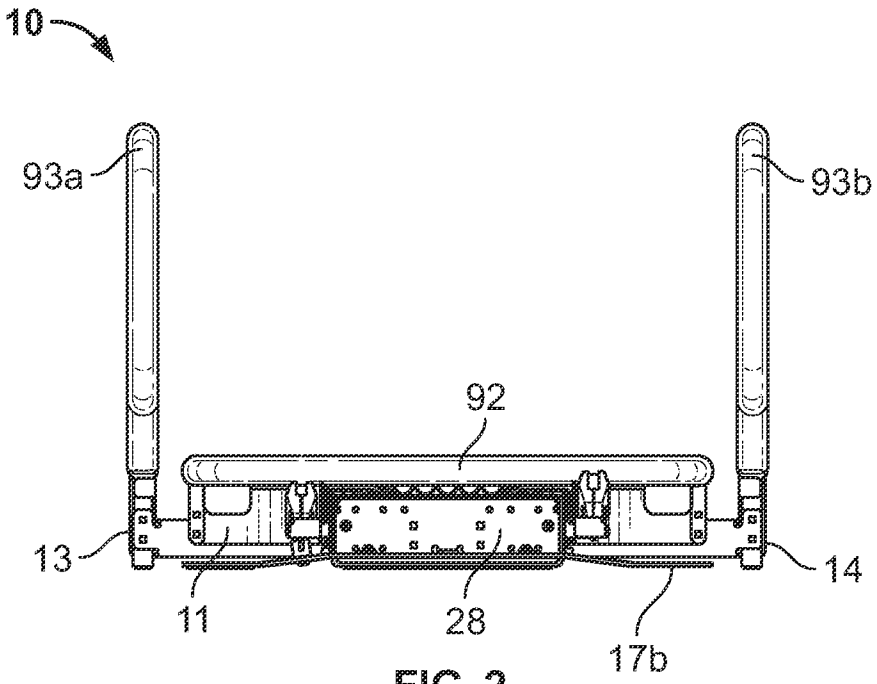
FIG. 2 is a first end view of an exercise machine rail system in accordance with an example embodiment.

The first connectors 44, 54 and first flanges 45, 55 of the first spacer 40 are matingly engaged with corresponding first inner connectors 23, 33 of the first rail 20. The second connectors 46, 56 and second flanges 47, 57 of the second spacer 50 are matingly engaged with corresponding second inner connectors 23, 33 of the second rail 30. In this manner, the first and second spacers 40, 50 may be connected between the first and second rails 20, 30. The end plate 29 may be connected between the first and second rails 20, 30 at one of the ends 11, 12 of the exercise machine 10 to protect the interior space between the rails 20, 30. The end cover 28 may then be installed to cover the first and second rails 20, 30 such as shown in FIG. 2.

The one or more elongated members 81 may be positioned within each of the channels 63 defined between the dividers 62 (e.g. ribs) of the lower member 60 such as shown in FIG. 11. The elongated members 81 may be wound around a pair of pulleys 84, 85 and may be selectively and removably connectable to one or more biasing members 80 so as to impart a resistance force against movement of the carriage 70 in one or more directions. The manner in which the resistance force is imparted against the carriage 70 may vary widely in different embodiments. In some embodiments, the biasing members 80 may be directly connected to the carriage 70, such as to a resistance selector 78. In other embodiments, the biasing members 80 may be indirectly connected to the carriage 70, such as by use of elongated members 81 as shown in the figures.

In use, the exercise machine 10 may be mounted in various manners by a wide range of exercisers to perform a wide range of exercise movements. The exerciser may selectively connect (directly or indirectly) one or more of the biasing members 80 to the carriage 70 so as to impart a resistance force against movement of the carriage 70 in one or more directions. The exerciser may then mount the carriage 70 and move the carriage 70 in one or more directions to perform various exercise movements. The exerciser may place various body parts (e.g., legs, arms, hands, feet) on various structures of the exercise machine 10 (e.g., the end platform 90, carriage platform 71, etc.) when performing such exercise movements.

Unless otherwise defined, all technical and scientific terms used herein have the same meaning as commonly understood by one of ordinary skill in the art to which this invention belongs. Although methods and materials similar to or equivalent to those described herein can be used in the practice or testing of the various embodiments of the present disclosure, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The various embodiments of the present disclosure may be embodied in other specific forms without departing from the spirit or essential attributes thereof, and it is therefore desired that the various embodiments in the present disclosure be considered in all respects as illustrative and not restrictive. Any headings utilized within the description are for convenience only and have no legal or limiting effect.

What is claimed is:

1. An exercise machine, comprising:

a fixed frame comprising:

a first rail having a first inner connector;

a second rail having a second inner connector;

a first spacer positioned intermediate the first rail and the second rail, wherein the first spacer has a first connector that is slidably received within the first inner connector and a second connector that is slidably received within the second inner connector to form the fixed frame;

a carriage movably connected to the first rail and the second rail, wherein the carriage is adapted to be movable along a portion of the first rail and the second rail; and at least one elongated member adapted to be connected to the carriage.

2. The exercise machine of claim 1, wherein the first spacer extends along at least 65% of the length of the first rail and at least 65% of the length of the second rail.

3. The exercise machine of claim 1, wherein the first spacer extends along at least 70% of the length of the first rail and at least 70% of the length of the second rail.

4. The exercise machine of claim 1, wherein the first spacer extends along at least 95% of the length of the first rail and at least 95% of the length of the second rail.

5. The exercise machine of claim 1, further comprising at least one pulley positioned between the first rail and the second rail, wherein the at least one elongated member is connected to the at least one pulley, wherein the first spacer includes an upper opening, and wherein the at least one pulley extends partially out of the upper opening.

6. The exercise machine of claim 1, wherein the first connector comprises a first flange, wherein the second connector comprises a second flange, wherein the first inner connector includes a first receiver slot, wherein the second inner connector includes a second receiver slot, wherein the first flange is adapted to engage within the first receiver slot, and wherein the second flange is adapted to engage within the second receiver slot.

7. The exercise machine of claim 6, wherein the first flange and the second flange each extend along an entire length of the first spacer.

8. The exercise machine of claim 1, wherein the first spacer is comprised of an inverted U-shape.

9. The exercise machine of claim 1, wherein the first spacer is comprised of a central portion, a first side portion extending downwardly at an angle from a first side of the central portion, and a second side portion extending downwardly at an angle from a second side of the central portion.

10. The exercise machine of claim 1, wherein the first spacer is comprised of a sheet of material.

11. The exercise machine of claim 1, wherein the first spacer encloses a gap between the first rail and the second rail.

12. The exercise machine of claim 1, further comprising a first side insert positioned between a first side of the first spacer and the first rail and a second side insert positioned between a second side of the first spacer and the second rail.

13. The exercise machine of claim 1, further comprising a lower member extending between the first rail and the second rail below the first spacer.

14. The exercise machine of claim 13, wherein the lower member includes a plurality of ribs defining a plurality of channels, and wherein the at least one elongated member is positioned within at least one of the plurality of channels.

15. The exercise machine of claim 1, further comprising a second spacer extending between the first rail and the second rail and an upper opening positioned between the first spacer and the second spacer.

16. The exercise machine of claim 15, wherein the second spacer extends along less than half of the length of the first rail and less than half of the length of the second rail.

17. The exercise machine of claim 1, wherein the carriage travels over a top surface of the connected first rail, second rail, and first spacer.

18. The exercise machine of claim 1, wherein the first inner connector is of a t-shape that defines an upper slot and a lower slot, wherein the upper slot of the first inner connector matingly receives a first flange of the first connector and wherein the second inner connector is of a t-shape that defines an upper slot and a lower slot, wherein the upper slot of the second inner connector matingly receives a second flange of the second connector.

19. The exercise machine of claim 1, wherein the first spacer extends along at least half of a length of the first rail and at least half of a length of the second rail.

20. An exercise machine, comprising:

a first rail including a first inner edge and a first outer edge;

a second rail including a second inner edge and a second outer edge, wherein the first rail includes a first channel along the first outer edge, wherein the second rail includes a second channel along the second outer edge, and wherein the first rail is parallel to the second rail;

a carriage movably connected to the first rail and the second rail, wherein the carriage is adapted to be movable along a portion of the first rail and the second rail, wherein the carriage includes a first wheel and a second wheel, wherein the first wheel is adapted to move within the first channel, and wherein the second wheel is adapted to move within the second channel;

at least one elongated member adapted to be connected to the carriage, a first spacer extending between the first rail and the second rail, wherein the first spacer extends along at least half of a length of the first rail and at least half of a length of the second rail, wherein a first side of the first spacer is connected to the first inner edge of the first rail, and wherein a second side of the first spacer is connected to the second inner edge of the second rail;

a second spacer extending between the first rail and the second rail, wherein the second spacer extends along less than half of the length of the first rail and less than half of the length of the second rail;

a first side insert connected between the first side of the first spacer and the first rail;

a second side insert connected between the second side of the first spacer and the second rail;

an upper opening between the first spacer and the second spacer; and a pulley positioned between the first rail and the second rail, wherein the pulley extends partially out of the upper opening, and wherein the at least one elongated member is connected to the pulley.

21. An exercise machine, comprising:

a fixed frame comprising:

a first rail having a first inner connector that includes a first slot;

a second rail having a second inner connector that includes a second slot;

a first spacer extending between the first rail and the second rail, wherein the first spacer includes a first flange that interfaces with the first slot and a second flange that interfaces with the second slot to establish the fixed frame, and wherein the first spacer extends along at least half of a length of the first rail and at least half of a length of the second rail;

a carriage movably connected to the first rail and the second rail, wherein the carriage is adapted to be movable along a portion of the first rail and the second rail; and at least one elongated member adapted to be connected to the carriage.

22. The exercise machine of claim 21, wherein the first flange of the first spacer is slidably received within the first slot of the first rail and wherein the second flange of the first spacer is slidably received within the second slot of the second rail.

* * * * *